US009248367B2

(12) United States Patent
Imbrie et al.

(10) Patent No.: US 9,248,367 B2
(45) Date of Patent: Feb. 2, 2016

(54) NOSEGUARD ASSEMBLIES FOR SKATEBOARDS AND RELATED METHODS OF USE

(71) Applicant: ORIGINAL SKATEBOARDS, LLC, Newton, NJ (US)

(72) Inventors: Timothy Scott Imbrie, Newton, NJ (US); Joel Penkala, Sandyston, NJ (US)

(73) Assignee: Original Skateboards, LLC, Newton, NJ (US)

( * ) Notice: Subject to any disclaimer, the term of this patent is extended or adjusted under 35 U.S.C. 154(b) by 0 days.

(21) Appl. No.: 14/336,397

(22) Filed: Jul. 21, 2014

(65) Prior Publication Data

US 2015/0021874 A1 Jan. 22, 2015

Related U.S. Application Data

(60) Provisional application No. 61/856,958, filed on Jul. 22, 2013.

(51) Int. Cl.

| | |
|---|---|
| ***B62M 1/00*** | (2010.01) |
| ***A63C 17/01*** | (2006.01) |
| ***A63C 17/00*** | (2006.01) |

(52) U.S. Cl.

CPC ..... *A63C 17/015* (2013.01); *A63C 17/002* (2013.01); *A63C 2201/02* (2013.01); *A63C 2203/42* (2013.01)

(58) Field of Classification Search

CPC ..... B62M 1/00; A63C 11/00; A63C 10/08; A63C 11/20

USPC ..... 280/87.042, 809, 841, 608, 11.208, 280/11.209, 816

See application file for complete search history.

(56) References Cited

U.S. PATENT DOCUMENTS

| | | | | |
|---|---|---|---|---|
| 3,075,816 | A | 1/1963 | Harris et al. | |
| 3,374,495 | A * | 3/1968 | Joyce | 441/74 |
| D222,158 | S | 10/1971 | Noches | |
| 3,990,713 | A * | 11/1976 | Hokanson | 280/87.042 |

(Continued)

OTHER PUBLICATIONS

Website pages from http://pritchardskatedesigns.com dated Apr. 25, 2013, pp. 1-3.

(Continued)

*Primary Examiner* — Hau Phan
(74) *Attorney, Agent, or Firm* — McCarter & English

(57) ABSTRACT

The present disclosure provides advantageous skateboard assemblies (e.g., advantageous skateboard guard assemblies). More particularly, the present disclosure provides advantageous guard/noseguard assemblies for skateboards and related methods of use. The present disclosure provides for mountable, interchangeable and/or removable guard/noseguard assemblies for skateboards. The skateboard guard assemblies typically include a contoured or shaped top surface, each contoured/shaped top surface configured and dimensioned to provide the user/rider at least one advantageous surface that a user/rider can position a foot onto/over during use (e.g., a surface that a user/rider can utilize to place or position a foot directly onto/above, with the bottom side of the user's foot contacting the top surface of the guard assembly). Exemplary guard/noseguard assemblies of the present disclosure also provide protection purposes for the skateboard deck, and/or modify the bottom surface angle of the board kicktail to change the point of contact (e.g., during an Ollie or the like).

17 Claims, 14 Drawing Sheets

(56) References Cited

U.S. PATENT DOCUMENTS

| | | | | |
|---|---|---|---|---|
| 4,140,326 | A * | 2/1979 | Huber | 280/87.042 |
| 4,160,554 | A | 7/1979 | Cooney | |
| 4,739,723 | A | 4/1988 | Plucknett | |
| 4,997,196 | A * | 3/1991 | Wood | 280/87.042 |
| 5,292,141 | A | 3/1994 | Ekedal et al. | |
| 5,310,221 | A | 5/1994 | Schmidt | |
| 5,458,351 | A | 10/1995 | Yu | |
| 5,833,252 | A * | 11/1998 | Strand | 280/87.042 |
| 5,975,546 | A * | 11/1999 | Strand | 280/87.042 |
| 6,012,734 | A * | 1/2000 | Skedeleski | 280/610 |
| 6,036,218 | A * | 3/2000 | Muff, Jr. | 280/608 |
| 6,059,315 | A * | 5/2000 | Selph | 280/809 |
| 6,145,857 | A * | 11/2000 | Bernstein | 280/87.042 |
| 6,565,104 | B1 * | 5/2003 | Colon | 280/87.042 |
| 6,802,636 | B1 * | 10/2004 | Bailey, Jr. | 280/87.042 |
| 6,817,622 | B2 | 11/2004 | Dodge | |
| 6,945,837 | B2 | 9/2005 | Crumrine et al. | |
| 7,314,223 | B2 | 1/2008 | Lin | |
| 7,390,010 | B2 | 6/2008 | Elkington et al. | |
| 7,410,181 | B2 * | 8/2008 | Colon | 280/87.042 |
| 7,628,412 | B2 * | 12/2009 | Colon | 280/87.042 |
| 8,047,556 | B2 * | 11/2011 | Jang et al. | 280/87.042 |
| 8,104,776 | B2 | 1/2012 | Messmer et al. | |
| 8,506,140 | B2 * | 8/2013 | Edmisten | 280/87.042 |
| 2003/0075890 | A1 * | 4/2003 | Jacobs | 280/87.042 |
| 2003/0155733 | A1 * | 8/2003 | Tan et al. | 280/87.042 |
| 2003/0160410 | A1 * | 8/2003 | Yang | 280/87.042 |
| 2004/0257831 | A1 * | 12/2004 | Liao | 362/565 |
| 2006/0273550 | A1 | 12/2006 | Delago | |
| 2008/0216948 | A1 | 9/2008 | Delehanty | |
| 2009/0134551 | A1 | 5/2009 | Delehanty | |
| 2011/0211363 | A1 * | 9/2011 | Hurwitz | 362/545 |

OTHER PUBLICATIONS

Written Opinion dated Dec. 15, 2014 relating to co-pending International Application No. PCT/US2014/047404.

* cited by examiner

NOSEGUARD ASSEMBLIES FOR SKATEBOARDS AND RELATED METHODS OF USE

CROSS-REFERENCE TO RELATED APPLICATIONS

This application claims the benefit of U.S. Provisional Application No. 61/856,958 filed Jul. 22, 2013, all of which is herein incorporated by reference in its entirety.

BACKGROUND

1. Technical Field

The present disclosure relates to skateboard assemblies (e.g., guard or noseguard assemblies for skateboards) and, more particularly, to mountable, interchangeable and/or removable guard/noseguard assemblies for skateboards and related methods of use.

2. Background Art

In general, skateboards or the like are known. Some exemplary skateboards and related accessories or the like are described and disclosed in U.S. Pat. Nos. 3,990,713; 4,140,326; 5,833,252; 5,975,546; D222,158; 6,145,857 and 8,047,556, and U.S. Patent Pub. Nos. 2003/0155733 and 2003/0075890, and U.S. patent applications Ser. Nos. 14/321,154 and 61/841,531, the entire contents of each being hereby incorporated by reference in their entireties.

A constant need exists among skateboard end-users and/or manufacturers to develop skateboards and related accessories that are cost-effective and/or include improved features/structures.

Thus, an interest exists for improved skateboards and related accessories. These and other inefficiencies and opportunities for improvement are addressed and/or overcome by the assemblies, systems and methods of the present disclosure.

SUMMARY

The present disclosure provides advantageous skateboard assemblies (e.g., advantageous skateboard guard/noseguard assemblies). More particularly, the present disclosure provides advantageous mountable guard/noseguard assemblies for skateboards and related methods of use.

In exemplary embodiments, the present disclosure provides for mountable, interchangeable and/or removable guard/noseguard assemblies for skateboards. The skateboard guard/noseguard assemblies typically include a contoured or shaped top surface (e.g., ergonomically curved, shaped and/or contoured top surface), each contoured/shaped top surface configured and dimensioned to provide a user/rider at least one advantageous surface that the user/rider can position a foot (or feet) onto/over during use (e.g., a surface that a user/rider can utilize to place or position a foot directly onto/above, with the bottom side of the user's foot contacting the contoured top surface of the guard/noseguard assembly during use).

In exemplary embodiments, the noseguard assemblies are configured and dimensioned to modify the top surface of the skateboard assembly (e.g., of the skateboard deck) for improved grip and/or to add more informative surfaces for the rider to stand on.

The noseguard assemblies can also be configured and dimensioned to modify the bottom surface angle of the board kicktail to change the point of contact during an ollie, when the board contacts the ground (e.g., to improve the height, spin and/or rotation of the trick being performed).

The guard/noseguard assemblies can also extend the board/deck length/width of the skateboard assembly, thereby adding additional material to the board (e.g., to the nose and/or tail of the board, and/or to the sides of the board, and/or to other outwardly facing edges/surfaces of the board) for (impact) protection purposes or the like.

In exemplary embodiments, the noseguard assemblies include a slotted noseguard base or the like that allows the rider to visually see or determine when the noseguard assembly has worn away and needs to be changed/replaced. For example, as material is removed from the noseguard assembly, the slots become visible externally, and when this happens the noseguard assembly may have lost enough material to be weakened and therefore can be replaced.

The unique fabrication/molding design and/or hardware system/assembly of certain exemplary noseguard assemblies of the present disclosure ensures that the inner top surface of the noseguard is pulled substantially flush to the outer top surface of the skateboard deck, while substantially simultaneously the bottom hardware support members or nuts or the like are each substantially flush in contact with the bottom surface of the deck, and substantially flush in contact with the noseguard wing members to effectively support the top surface interface (e.g., the interface between the inner top surface of the noseguard and the top surface of the skateboard deck).

The top surface of the noseguard assembly can increase the top angle of the kicktail, relative to the original angle built into the board shape, which increases leverage and allows the rider to pop the board faster.

In addition to early contact with the ground (e.g., providing improved ollies), the extended bottom surface of the noseguard assembly allows for more wearable material to be added to the noseguard, and thus it takes riders longer to wear the noseguard away to the point where it needs replaced.

Any combination or permutation of embodiments is envisioned. Additional advantageous features, functions and applications of the disclosed assemblies, systems and methods of the present disclosure will be apparent from the description which follows, particularly when read in conjunction with the appended figures. All references listed in this disclosure are hereby incorporated by reference in their entireties.

BRIEF DESCRIPTION OF THE DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various features, steps and combinations of features/steps described below and illustrated in the figures can be arranged and organized differently to result in embodiments which are still within the spirit and scope of the present disclosure. To assist those of ordinary skill in the art in making and using the disclosed systems, assemblies and methods, reference is made to the appended figures, wherein.

DETAILED DESCRIPTION

Figure 1:
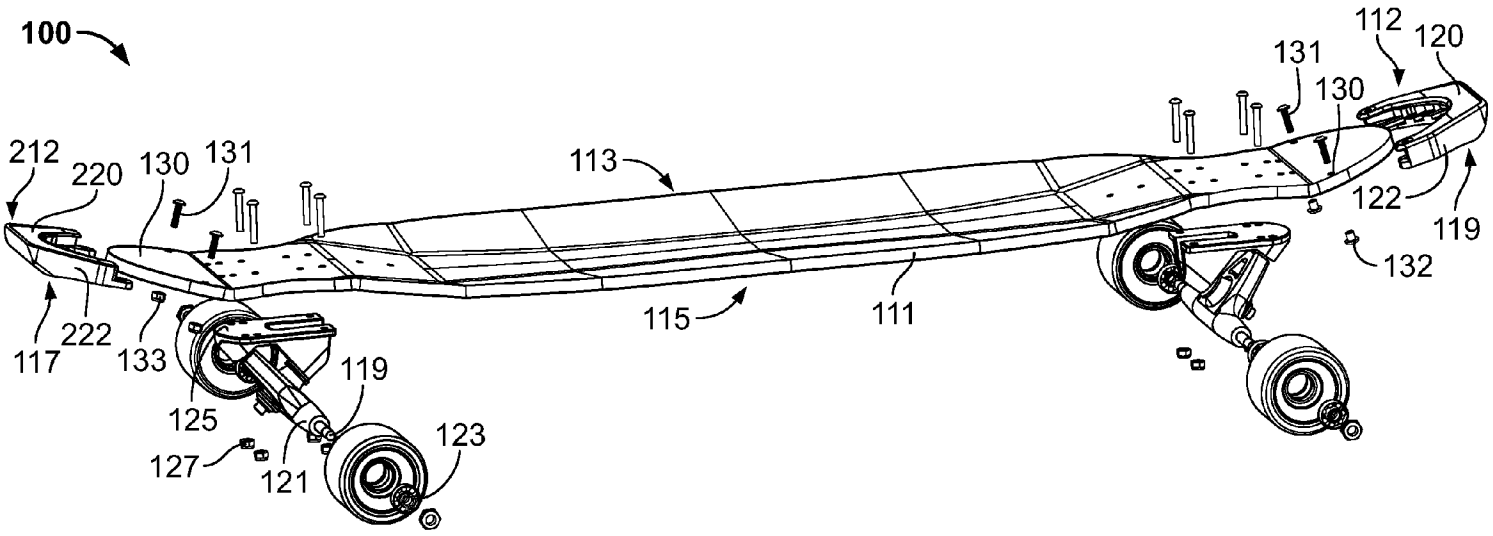
FIG. 1 is a side perspective view of an exemplary skateboard assembly according to the present disclosure, prior to exemplary guard/noseguard assemblies being mounted thereon.

The exemplary embodiments disclosed herein are illustrative of advantageous skateboard assemblies and/or guard/noseguard assemblies, and systems of the present disclosure and methods/techniques thereof. It should be understood, however, that the disclosed embodiments are merely exemplary of the present disclosure, which may be embodied in various forms. Therefore, details disclosed herein with reference to exemplary skateboard assemblies or guard/noseguard assemblies or fabrication methods and associated processes or techniques of assembly and use are not to be interpreted as limiting, but merely as the basis for teaching one skilled in the art how to make and use the advantageous assemblies/systems and/or alternative assemblies/systems of the present disclosure.

The present disclosure provides improved skateboard assemblies (e.g., advantageous skateboard guard/noseguard assemblies). More particularly, the present disclosure provides mountable guard/noseguard assemblies for skateboards and related methods of use.

The present disclosure provides for mountable, interchangeable and/or removable guard/noseguard assemblies for skateboards. In exemplary embodiments, the skateboard guard/noseguard assemblies include a contoured or shaped top surface (e.g., ergonomically curved, shaped and/or contoured top surface), each contoured/shaped top surface configured and dimensioned to provide the user/rider at least one advantageous surface that a user/rider can position a foot (or feet) onto/over during use. In general, the surface provided by the noseguard assemblies is a surface that a user/rider can utilize to place or position a foot directly onto/above, with the bottom side of the user's foot contacting the contoured top surface of the noseguard assembly during use of the skateboard assembly.

Current practice provides that some skateboard users/riders desire to have additional types of surfaces or geometries under their foot or feet while riding, other than the surfaces that are available on their skateboard.

In exemplary embodiments, the present disclosure provides for cost-effective and mountable, interchangeable and/or removable guard/noseguard assemblies for skateboards, the skateboard guard/noseguard assemblies including a top surface (e.g., an ergonomic and/or contoured top surface), each top surface configured and dimensioned to provide a user at least one advantageous surface (e.g., a curved/contoured surface) that the user can position a foot onto/over during use, thereby providing a significant operational, commercial and/or manufacturing advantage as a result.

Exemplary guard/noseguard assemblies of the present disclosure also provide (impact) protection purposes for the skateboard deck (e.g., for the nose and/or tail of the deck/board, and/or for the sides of the deck/board, and/or for other outwardly facing edges/surfaces of the board), and/or modify the bottom surface angle of the board kicktail to change the point of contact (e.g., during an Ollie or the like).

Referring now to the drawings, like parts are marked throughout the specification and drawings with the same reference numerals, respectively. Drawing figures are not necessarily to scale and in certain views, parts may have been exaggerated for purposes of clarity.

With reference to FIG. 1, there is illustrated an embodiment of an exemplary skateboard assembly 100 according to the present disclosure. In general, skateboard assembly 100 is configured and dimensioned for skateboarding or riding purposes. It is noted that skateboard assembly 100 can take a variety of forms and/or designs.

In general, skateboard assembly 100 includes a skateboard deck 111, the skateboard deck 111 typically having a top side 113, a bottom side 115, left side 198, right side 199, and a front end 117 and a rear end 119. Top side 113 is typically configured and adapted to receive at least a portion of the feet of a rider. Skateboard deck 111 can be fabricated from a variety of materials and/or combination of materials, such as, for example, wood or wood-based materials or the like, metal or metal-based materials or the like, and/or plastic or plastic-based materials or the like, although the present disclosure is not limited thereto. Rather, it is noted that skateboard deck 111 can be fabricated from a variety of materials and/or combination of materials, and can take a variety of shapes, styles and/or designs.

Figure 2:
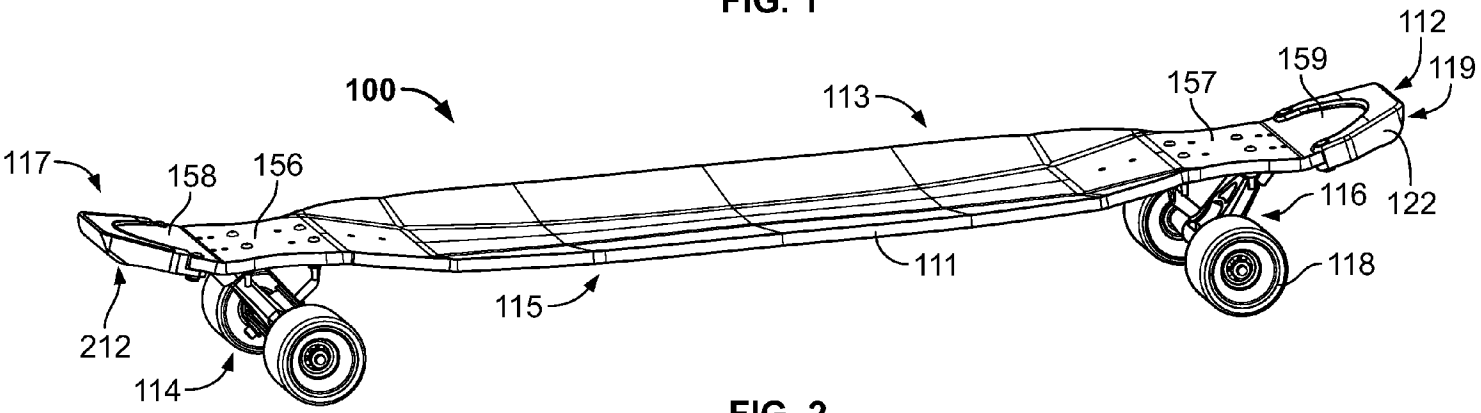
FIG. 2 is a side perspective view of the assemblies of FIG. 1 after assembly.
Figure 3:
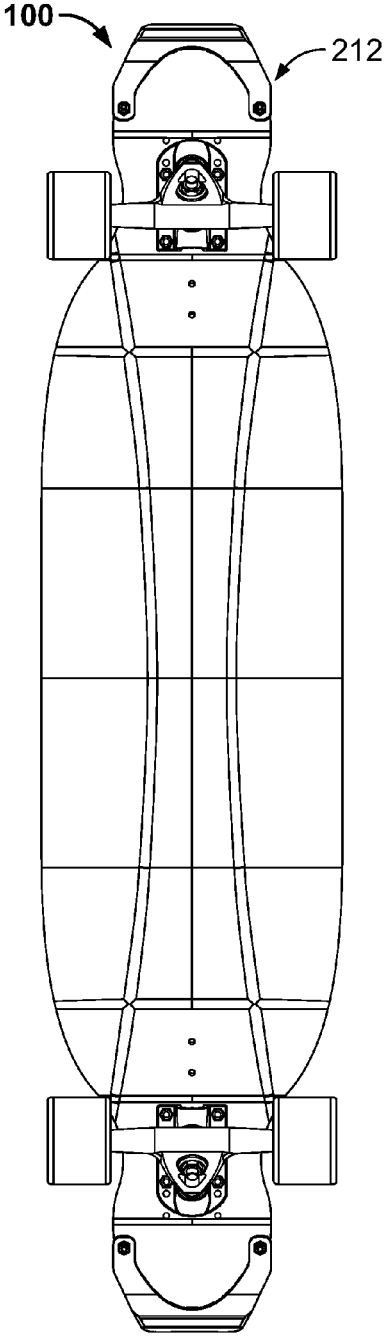
FIG. 3 is a bottom view of the skateboard assembly of FIG. 2.

As shown in FIGS. 1-2, skateboard assembly 100 typically includes a first (e.g., fore) truck assembly 114 and a second (e.g., aft) truck assembly 116. In exemplary embodiments, each truck assembly 114, 116 is positioned underneath and/or mounted with respect to the bottom side 115 of skateboard deck 111.

In general, each truck assembly 114, 116 includes one or more wheels 118. In exemplary embodiments and as shown in FIG. 1, each truck assembly 114, 116 includes two wheels 118, although the present disclosure is not limited thereto. In certain embodiments, each truck assembly 114, 116 includes an axle 119 housed in a hanger member 121, each axle 119 rotatably mounted with respect to bearings 123. As shown in FIG. 1, a baseplate member 125 is typically mounted with respect to each hanger member 121. Securement members 127 (e.g., nuts) typically allow wheels 118 and bearings 123 to be mounted with respect to axle 119. It is noted that truck assemblies 114 and/or 116 can take/have a variety of suitable forms/configurations/members.

Figure 4:
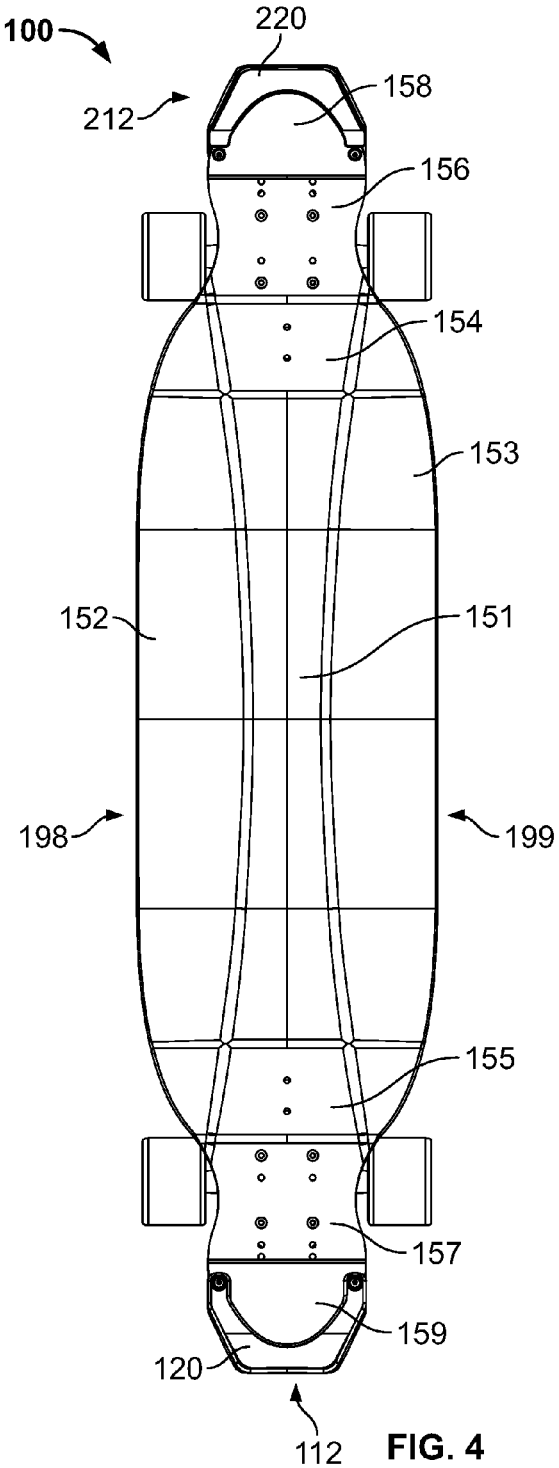
FIG. 4 is a top view of the skateboard assembly of FIG. 2.
Figure 5:
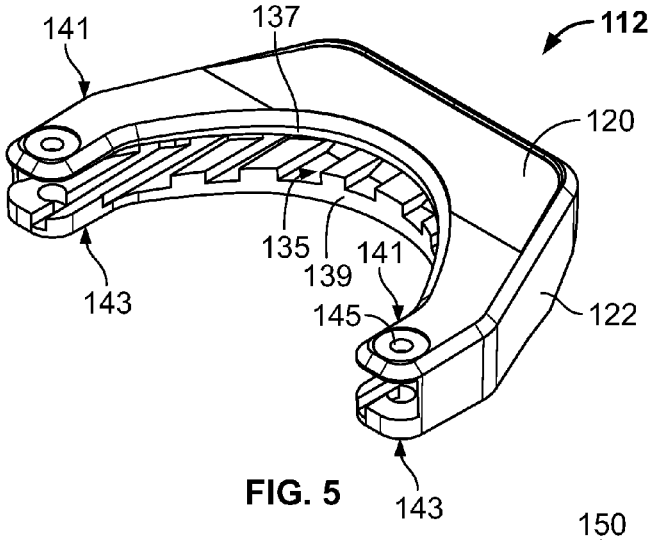
FIG. 5 is top side perspective view of a noseguard assembly of FIG. 1.
Figure 6:
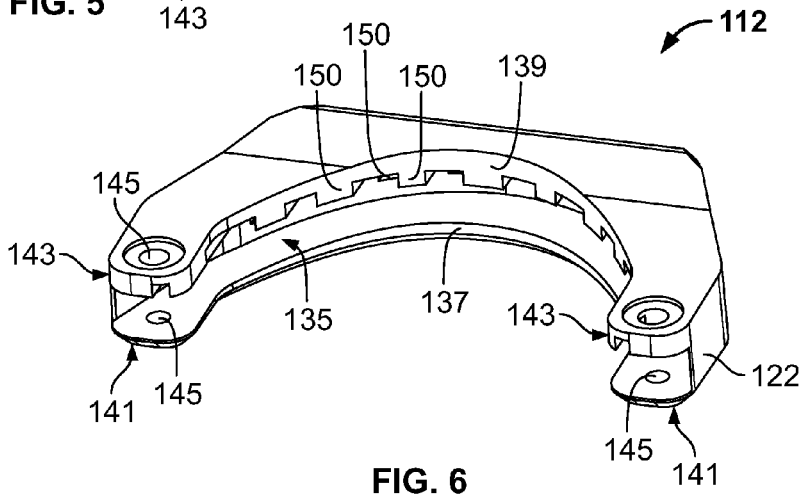
FIG. 6 is a bottom side perspective view of the noseguard assembly of FIG. 5.
Figure 7:
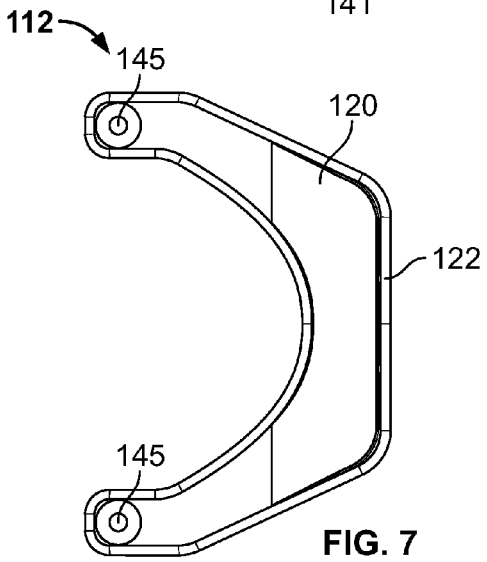
FIG. 7 is a top view of the noseguard assembly of FIG. 5.

In certain embodiments and as shown in FIGS. 1-2 and 4, the skateboard deck 111 of assembly 100 includes a plurality of sections having different planar angles. More particularly, deck 111 includes a central section 151 that can be substantially planar or flat, and central side sections 152, 153 that angle upwardly relative to central section 151. Moreover, deck can include a first forward angled section 154 that angles upward relative to central section 151, a first rear angled section 155 that angles upward relative to central section 151, a first forward planar section 156 that can be substantially planar/flat and/or define a plane that is substantially parallel to central section 151, a first rear planar section 157 that can be substantially planar/flat and/or define a plane that is substantially parallel to central section 151, a second forward angled section 158 that angles upward relative to central section 151, and/or a second rear angled section 159 that angles upward relative to central section 151. In general, the deck 111 having a plurality of sections having different planar angles provide predictable contact platforms for the addition of noseguard assemblies and/or other add-ons or the like.

In general, exemplary skateboard assembly 100 includes one or more guard/noseguard assembly 112 and/or 212. In exemplary embodiments and as discussed further below, the guard/noseguard assemblies 112, 212 are mountable, interchangeable and/or removable relative to skateboard assembly 100 (e.g., relative to skateboard deck 111). As discussed further below, each guard/noseguard assembly 112, 212 generally is configured to be mounted with respect to the top side 113 and/or bottom side 115 of the skateboard deck 111 (e.g., for protection purposes for deck 111, and/or to give the user a more advantageous surface, position and/or geometry to place or position their feet on the skateboard assembly 100, and/or to modify the bottom surface angle of the board kick-tail to change the point of contact during an Ollie, etc.).

Each guard/noseguard assembly 112, 212 typically includes at least one guard/noseguard member 122, 222 that has or defines a contoured or shaped top surface 120, 220 (e.g., an ergonomically curved, shaped and/or contoured top surface 120, 220). In general, each contoured/shaped top surface 120, 220 is configured and dimensioned to provide a user/rider at least one advantageous surface 120, 220 that the user/rider can position a foot or feet onto, over and/or above during use of skateboard assembly 100. In other words, each contoured/shaped top surface 120, 220 is configured to provide a user with one or more surfaces that the user can utilize to place or position a foot directly onto/above/against, with the bottom side of the user's foot contacting the contoured top surface 120, 220 of the guard/noseguard member 122, 222 during use of mounted guard/noseguard assembly 112, 212.

In exemplary embodiments and as shown in FIGS. 1-2, guard/noseguard assembly 112 includes a guard/noseguard member 122 having a contoured top surface 120, the guard/noseguard assembly 112 configured and dimensioned to be mounted with respect to: (i) the rear end 119 (or front end 117) of the deck 111 (e.g., to second rear angled section 159), (ii) the top side 113 of the skateboard deck 111, and/or (iii) the bottom side 115 of the skateboard deck 111.

In other embodiments, it is noted that guard assembly 112 can be configured and dimensioned to be mounted with respect to: (i) left or right side 198, 199 of the deck, (ii) the top side 113 of the skateboard deck 111, and/or (iii) the bottom side 115 of the skateboard deck 111 (e.g., for protection or rail guard purposes for deck 111).

Similarly, guard/noseguard assembly 212 includes a guard/noseguard member 222 having a contoured top surface 220, the guard/noseguard assembly 212 configured and dimensioned to be mounted with respect to: (i) the front end 117 (or rear end 119) of the deck 111 (e.g., to second forward angled section 158), (ii) the top side 113 of the skateboard deck 111, and/or (iii) the bottom side 115 of the skateboard deck 111.

In other embodiments, it is noted that guard assembly 212 can be configured and dimensioned to be mounted with respect to: (i) left or right side 198, 199 of the deck, (ii) the top side 113 of the skateboard deck 111, and/or (iii) the bottom side 115 of the skateboard deck 111 (e.g., for protection or rail guard purposes for deck 111).

It is noted that assembly 112 could be mounted similar to and in lieu of assembly 212 (e.g., to front end 117), and that assembly 212 could be mounted to rear end 119. Assemblies 112 and 212 typically are mounted to skateboard assembly 100 utilizing holes/apertures 130 that are not typically associated with truck assembly 114 or 116, although the present disclosure is not limited thereto. Apertures 130 may be positioned at any suitable location on deck 111.

In exemplary embodiments, at least a portion of the contoured top surfaces 120, 220 of guard members 122, 222 rise, slant, curve and/or slope upwardly and/or inwardly. It is noted that top surfaces 120, 220 can take a variety of shapes, sizes and/or forms (e.g., curved, conical, rounded, slanted, undulating, planar, elevated, etc.).

Guard/noseguard members 122, 222 (or the other exemplary guard/noseguard members of the present disclosure discussed below) can be fabricated from a variety of suitable materials or combinations of materials, such as, for example and without limitation, plastic, nylon, polymers, hard plastic, moldable materials, metals, non-metals, wood, sticky and/or "grippy" grip-friendly and/or soft materials (e.g., urethane/rubber or the like) etc., and combinations thereof. Moreover and as further discussed below, some guard/noseguard members 122, 222, etc. (or some other exemplary guard/noseguard members of the present disclosure discussed below) can be fabricated (e.g., extruded, printed, and/or 3D printed onto the board/deck 111) via an additive process or the like.

In certain embodiments, it is noted that guard/noseguard members 122, 222, 322, 422 (or the other exemplary guard/ noseguard members of the present disclosure discussed below) can be fabricated (wholly or in part) from moldable/curable materials (e.g., self-adhesive moldable materials). The moldable/curable material may take a variety of forms (e.g., single or multi-part plastic, epoxy, clay, rubber, putty, room-temperature vulcanizing silicone composition, or other curable material, which is soft, or liquid, and then hardens, which is molded by hand, or otherwise, where the desired shape of the member is created and determined by the end user, by hand molding the material, or where the user uses a previously created cavity mold or other molding tool to press the curable material into the desired shape).

Exemplary self-adhesive moldable materials are described and disclosed in U.S. Patent Pubs. Nos. 2009/0134551 and 2008/0216948, the entire contents of each being hereby incorporated by reference in their entireties. Moreover and as discussed further below in connection with FIGS. 30-33, it is noted that exemplary moldable materials (e.g., hand-moldable and self-adhesive/curable compositions) can be utilized in conjunction with the exemplary guard/noseguard assemblies 112, 212, 312, 412, etc. of the present disclosure for mounting purposes (e.g., to deck 111).

As noted, guard/noseguard members 122, 222 (or the other exemplary guard/noseguard members of the present disclosure discussed below) can be fabricated (wholly or in part) from moldable materials. As such, the present disclosure provides for an assembly 100 incorporating a guard/noseguard member (e.g., 122, etc.) wholly, or partially, constructed/fabricated out of a single or multi-part plastic, epoxy, clay, rubber, putty, or other curable material, which is soft, or liquid, and then hardens, which is molded by hand, or otherwise, where at least a portion of the desired shape of the guard/noseguard member (e.g., 122) is created and determined by the end user (e.g., by hand molding the material, or where the user uses a previously created cavity mold or other molding tool to press/fabricate the curable material into the desired shape), thereby allowing the user to mount the guard/noseguard member (122) on and/or to the end/side and/or surface of the board/deck 111, or onto pre-existing grip tape abrasive/adhesive paper surface (e.g., on deck 111).

Moreover, it is noted that a mold having a shape and/or internal texture for wholly or partially assisting a user in the creation of a guard/noseguard member using a moldable/curable material (e.g., single or multi-part plastic, epoxy, clay, rubber, putty, or other curable material, which is soft and then hardens) can be utilized by a user. For example, the user can add the not yet cured curable/moldable material to the exemplary mold shape and then, prior to the moldable material hardening, press the mold assembly to the desired end/side and/or surface (e.g., end 117 and/or 119, and/or side 198, 199) of the skateboard, thereby causing the guard/noseguard member shape and texture to transfer to the moldable curable material, and causing the guard/noseguard member to adhere mechanically to the desired contact surface of the skateboard or to the grip tape abrasive adhesive paper applied to that skateboard.

Furthermore, it is noted that various tools or the like can be utilized by a user when fabricating (wholly or partially) the guard/noseguard member from a moldable/curable material. For example, a tool having a rolling/pressing surface/structure (e.g., a rolling barrel, rolling pin, cylinder, sphere or other rolling or pressing shaped object or a thin bendable thin paper like surface, where at least one object surface has geometric shapes, grids, lines, reversed readable text, or other extrusions, indentations or textures designed to transfer the impression of those shapes, grids, lines, text, extrusions, indentations or textures to the surface of the guard/noseguard member) can be utilized to fabricate the guard/noseguard member (122) from the moldable/curable material.

In exemplary embodiments, guard/noseguard assemblies 112, 212 are mounted with respect to skateboard assembly 100 with one or more fasteners or fastener members 131 (e.g., bolts or screws 131). In certain embodiments and as discussed further below, assemblies 112, 212 are mounted with respect to skateboard assembly 100 with one or more fasteners or fastener members 131, and with one or more fastener support members 132, and/or with one or more nut members 133 or the like.

In certain embodiments, assembly 112 is mounted with respect to: (i) the rear end 119 of the deck 111 (e.g., to second rear angled section 159), (ii) the top side 113 of the skateboard deck 111, and/or (iii) the bottom side 115 of the skateboard deck 111 by utilizing two fasteners 131 and two corresponding fastener support members 132.

Guard/noseguard member 122 includes a recess 135 (e.g., molded recess 135). In exemplary embodiments, recess 135 is configured and dimensioned to provide a space/recess (135) to allow at least a portion of the rear end 119 (or front end 117, or side 198, or side 199) to be positioned within recess 135, with a top wall portion 137 of the noseguard member 122 being positioned above the top side 113 of deck 111 (e.g., above second rear angled section 159), and with a bottom wall portion 139 being positioned below the bottom side 115 of deck 111 (e.g., below second rear angled section 159). In certain embodiments, the wall portions 137, 139 each define a plane that is angled about 2° relative to one another (e.g., the defined planes are not substantially parallel).

Each end of the top wall portion 137 defines a wing portion 141, and each end of the bottom wall portion 139 defines a wing portion 143. Each wing portion 141, 143 includes a hole or aperture 145 therethrough for securement purposes of assembly 112 to assembly 100.

In exemplary embodiments, to secure assembly 112 to assembly 100, a portion of the rear end 119 (or front end 117, or side 198, or side 199) is positioned within recess 135, with top wall portion 137 (and top holes 145) positioned above the top side 113, and with bottom wall portion 139 (and bottom holes 145) positioned below the bottom side 115. A fastener support member 132 is then positioned within or relative to each bottom hole 145, and a fastener member 131 is positioned through each top hole 145 and through apertures 130 of deck 111. Each respective fastener member 131 and fastener support member 132 is then secured (e.g., threadably secured), tightened or mounted with respect to one another, which thereby causes the top wall portion 137 to be secured against or proximal to the top side 113 of the deck 111, and causes the distal portion 134 of each fastener support member 132 to be secured against or proximal to the bottom side 115 of the deck 111 (e.g., without the bottom wall portion 139 substantially contacting the bottom side 115 of the deck 111).

In other embodiments, a fastener support member 132 is positioned through each top hole 145, and a fastener member 131 is positioned through each bottom hole 145 and through apertures 130 of deck 111. Each respective fastener member 131 and fastener support member 132 is then secured (e.g., threadably secured), tightened or mounted with respect to one another, which thereby causes the bottom wall portion 139 to be secured against or proximal to the bottom side 115 of the deck 111, and causes the distal portion 134 of each fastener support member 132 to be secured against or proximal to the top side 113 of the deck 111 (e.g., without the top wall portion 137 substantially contacting the top side 113 of the deck 111).

In exemplary embodiments, the recess 135 of guard/noseguard member 122 includes a plurality of slot members 150.

As material is removed from the guard/noseguard member 122, the slot members 150 become visible externally to the user, and when this happens the assembly 112 has lost enough material to be weakened and therefore needs to be replaced.

Figure 9:
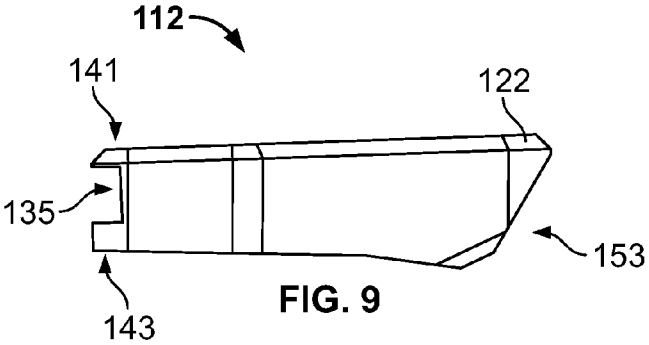
FIG. 9 is a side view of the noseguard assembly of FIG. 5.
Figure 11:
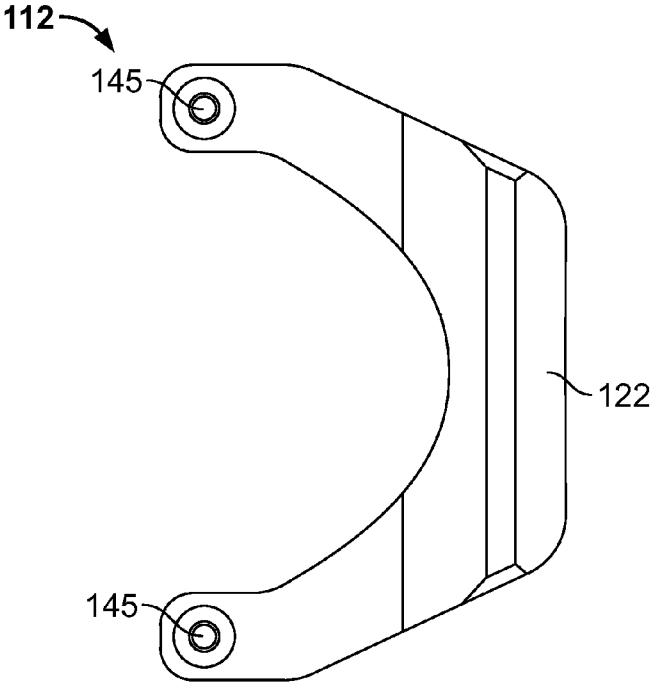
FIG. 11 is a bottom view of the noseguard assembly of FIG. 5.
Figure 8:
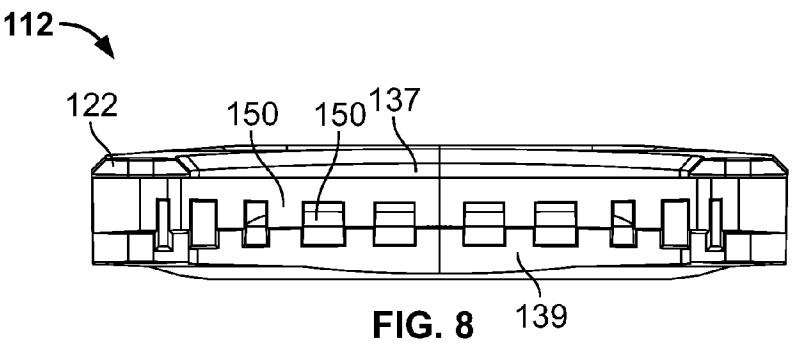
FIG. 8 is a rear view of the noseguard assembly of FIG. 5.
Figure 10:
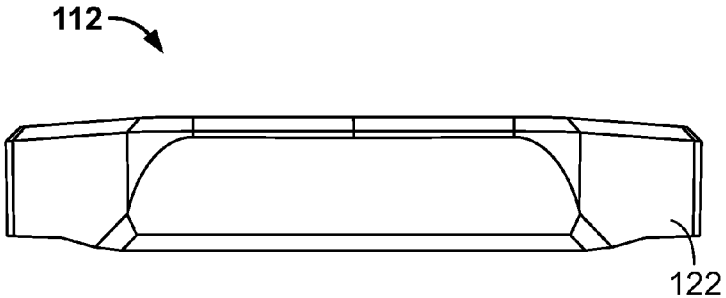
FIG. 10 is a front view of the noseguard assembly of FIG. 5.
Figure 12:
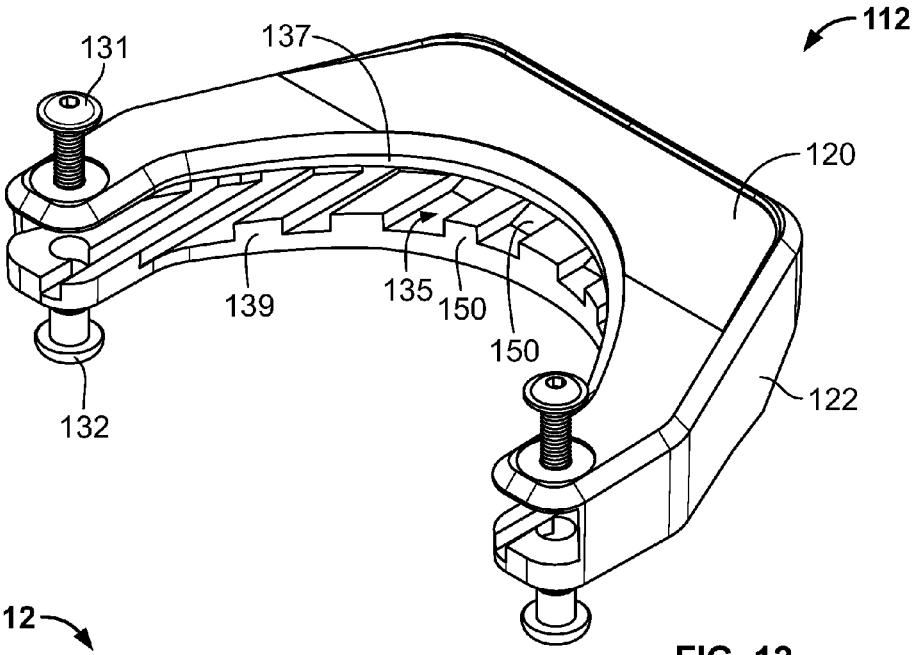
FIG. 12 is a top side perspective view of the noseguard assembly of FIG. 5.
Figure 13:
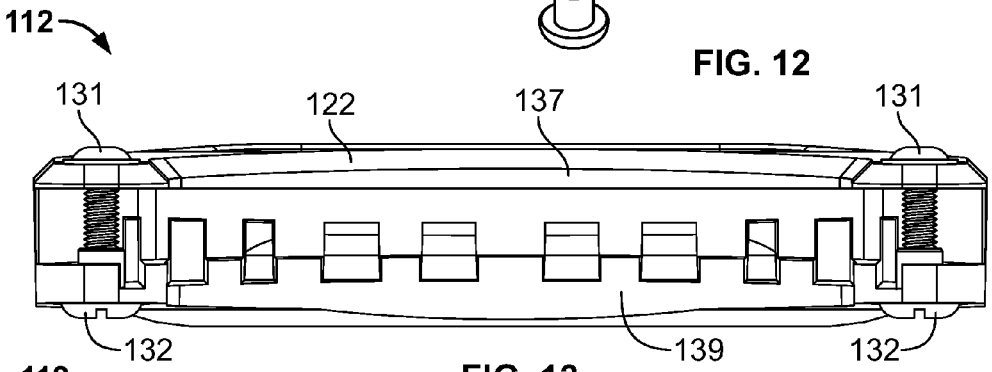
FIG. 13 is a rear view of the noseguard assembly of FIG. 5.
Figure 14:
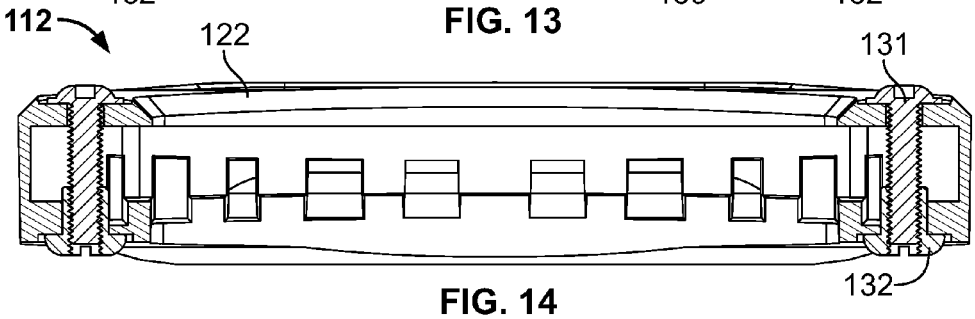
FIG. 14 is a rear cross-sectional view of the noseguard assembly of FIG. 5.
Figure 15:
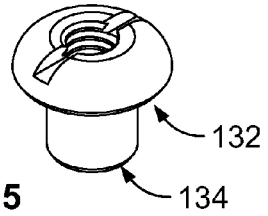
FIG. 15 is a side perspective view of a fastener support member of FIG. 12.
Figure 16:
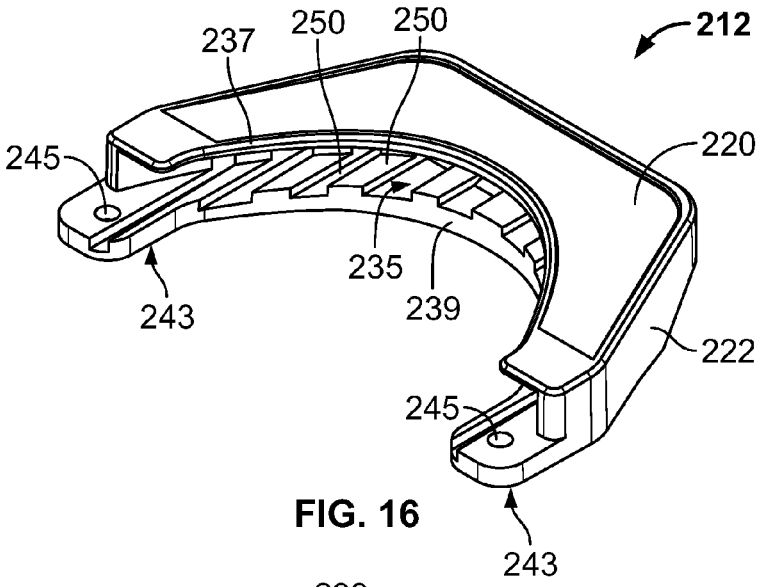
FIG. 16 is top side perspective view of another noseguard assembly of FIG. 1.
Figure 17:
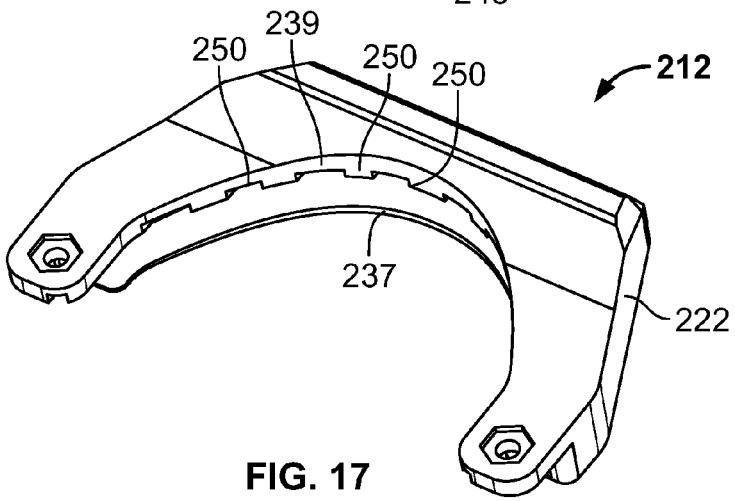
FIG. 17 is a bottom side perspective view of the noseguard assembly of FIG. 16.
Figure 18:
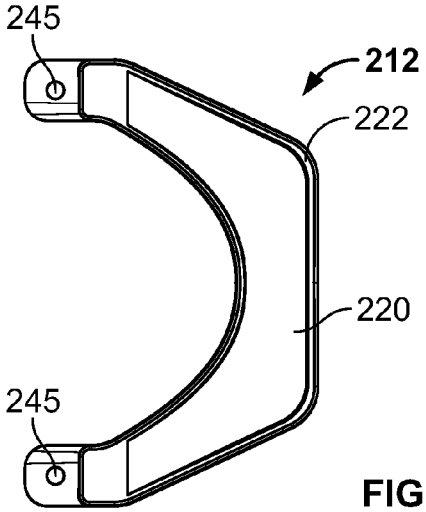
FIG. 18 is a top view of the noseguard assembly of FIG. 16.
Figure 19:
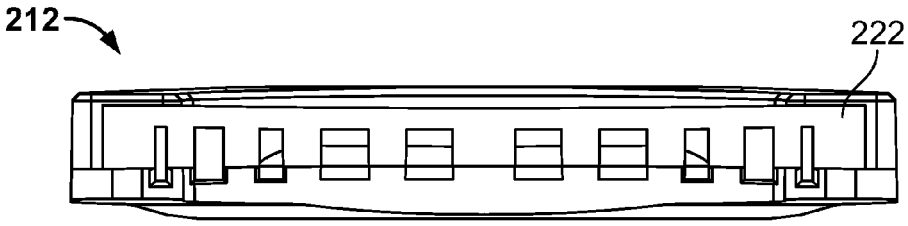
FIG. 19 is a rear view of the noseguard assembly of FIG. 16.

In certain embodiments and as shown in FIG. 9, guard/noseguard member 122 has a non-homogenous thickness (e.g., the ends defining wing portions 141, 143 is thinner than the opposite end 153 of the guard/noseguard member 122).

Exemplary assembly 112 (and/or the other guard/noseguard assemblies of the present disclosure discussed above and below) provides several advantages. For example, assembly 112 can be configured and dimensioned to modify the top surface of the skateboard assembly 100 (e.g., of the skateboard deck 111) for improved grip and to add more informative surfaces for the rider to stand on.

Assembly 112 can also be configured and dimensioned to modify the bottom surface angle of the board kicktail to change the point of contact during an ollie, when the board/assembly 100 contacts the ground (e.g., to improve the height, spin and/or rotation of the trick being performed).

Assembly 112 can also extend the board/deck/assembly 100 length/width of the skateboard assembly 100, thereby adding additional material to the board (e.g., to the nose and/or tail of the board, and/or to the sides of the board, and/or to other outwardly facing edges/surfaces of the board) for protection purposes or the like.

As noted, assembly 112 can include a slotted guard/noseguard base member 122 or the like (e.g., with slot members 150) that allows the rider to visually see or determine when the assembly 112 has worn away and needs to be changed/replaced. For example, as material is removed from the assembly 112, the slots 150 become visible externally, and when this happens the assembly 112 has lost enough material to be weakened and therefore needs to be replaced.

As discussed above, the unique fabrication/molding design and/or hardware system/assembly 112 of certain exemplary assemblies (e.g., assembly 112) of the present disclosure ensures that the inner top surface 137 of the guard/noseguard member 122 is pulled substantially flush to the outer top surface 113 of the skateboard deck 111, while substantially simultaneously the bottom hardware support members 132 or the like are both substantially flush in contact with the bottom surface 115 of the deck, and substantially flush in contact with the guard/noseguard wing members 143 to effectively support the top surface interface.

The top surface 120 of the assembly 112 can increase the top angle of the kicktail, relative to the original angle built into the board shape, which increases leverage and allows the rider to pop the board faster.

In addition to early contact with the ground (e.g., providing improved ollies), the extended bottom surface (e.g., end 153 of FIG. 9) of the assembly 112 allows for more wearable material to be added to the assembly 112, and thus it takes riders longer to wear the assembly 112 away to the point where it needs replaced.

With reference again to guard/noseguard assembly 212 (FIGS. 1-2, 4 and 16-22) and in certain embodiments, this guard/noseguard assembly 212 can be mounted with respect to: (i) the front end 117 (or end 119) of the deck 111, (ii) the top side 113 of the skateboard deck 111, and/or (iii) the bottom side 115 of the skateboard deck 111 by utilizing two fasteners 131 and two corresponding nut members 133.

Guard/noseguard member 222 includes a recess 235 (e.g., molded recess 235). In exemplary embodiments, recess 235 is configured and dimensioned to provide a space/recess (235) to allow at least a portion of the front end 117 (or rear end 119, or side 198, or side 199) to be positioned within recess 235, with a top wall portion 237 of the noseguard member 222 being positioned above the top side 113 of deck 111, and with a bottom wall portion 239 being positioned below the bottom side 115 of deck 111.

Each end of the bottom wall portion 239 defines a wing portion 243. Each wing portion 243 includes a hole or aperture 245 therethrough for securement purposes of assembly 212 to assembly 100.

In exemplary embodiments, to secure assembly 212 to assembly 100, a portion of the front end 117 (or rear end 119, or side 198, or side 199) is positioned within recess 235, with top wall portion 237 positioned above the top side 113, and with bottom wall portion 239 (and bottom holes 245) positioned below the bottom side 115. A nut member 133 is then positioned relative to each bottom hole 245, and a fastener member 131 is positioned (from top side 113) through apertures 130 of deck 111. Each respective fastener member 131 and nut member 133 is then secured (e.g., threadably secured), tightened or mounted with respect to one another, which thereby causes the top wall portion 237 to be secured against or proximal to the top side 113 of the deck 111, and causes the bottom wall portion 239 to be secured against or proximal to the bottom side 115 of the deck 111.

Figure 20:
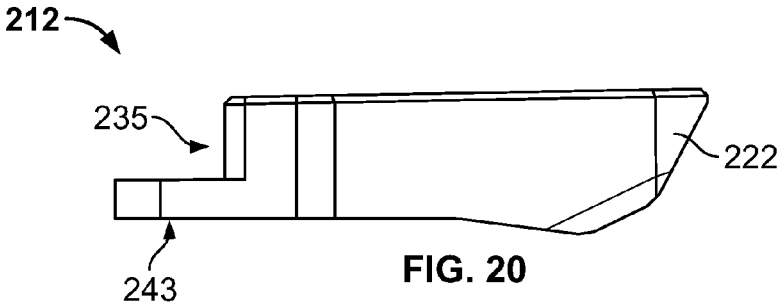
FIG. 20 is a side view of the noseguard assembly of FIG. 16.
Figure 21:
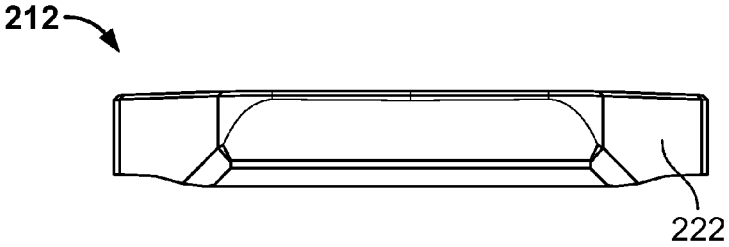
FIG. 21 is a front view of the noseguard assembly of FIG. 16.
Figure 22:
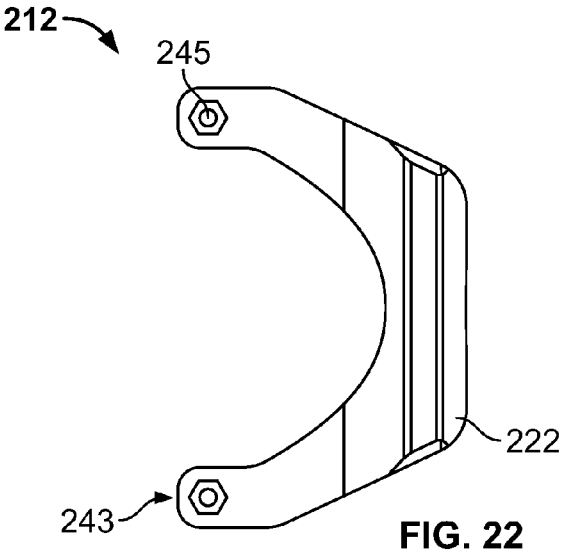
FIG. 22 is a bottom view of the noseguard assembly of FIG. 16.
Figure 23:
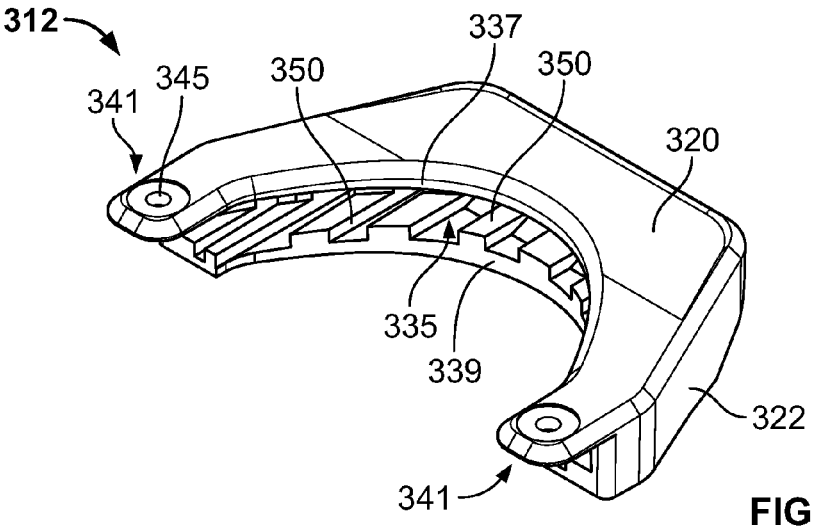
FIG. 23 is top side perspective view of another exemplary noseguard assembly of the present disclosure.
Figure 24:
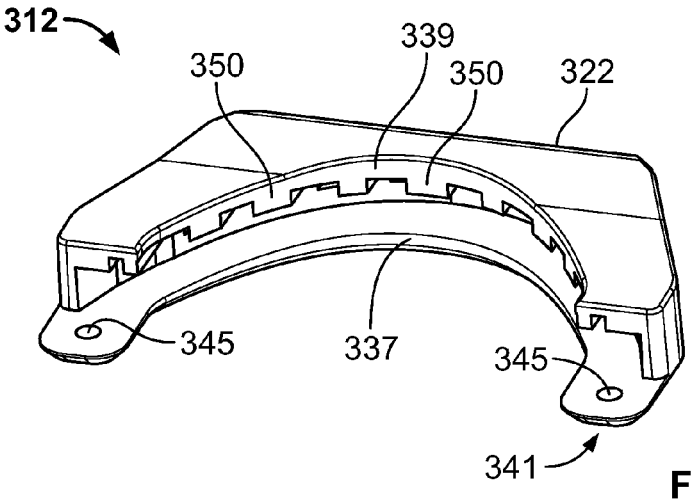
FIG. 24 is a bottom side perspective view of the noseguard assembly of FIG. 23.
Figure 25:
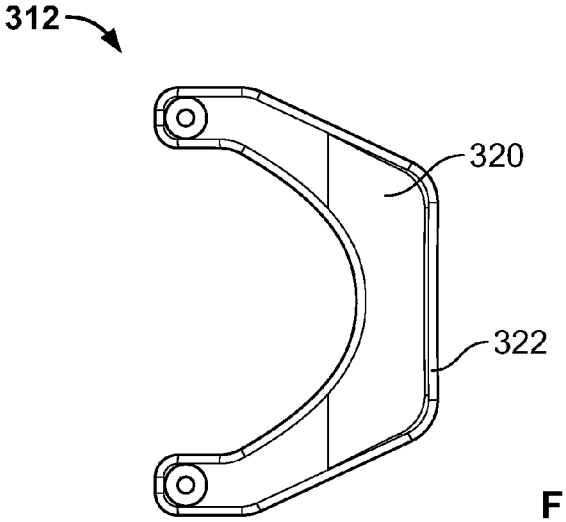
FIG. 25 is a top view of the noseguard assembly of FIG. 23.

In exemplary embodiments, the recess 235 of member 222 includes a plurality of slot members 250. As material is removed from the member 222, the slot members 250 become visible externally to the user, and when this happens the assembly 212 has lost enough material to be weakened and therefore needs to be replaced. In certain embodiments and as shown in FIG. 20, member 222 has a non-homogenous thickness.

In another embodiment and as shown in FIGS. 23-29, this guard/noseguard assembly 312 can be mounted with respect to: (i) the front end 117 (or rear end 119) of the deck 111, (ii) the top side 113 of the skateboard deck 111, and/or (iii) the bottom side 115 of the skateboard deck 111 (e.g., by utilizing two fasteners 131 and two corresponding nut members 133).

In other embodiments, it is noted that guard assembly 312 can be configured and dimensioned to be mounted with respect to: (i) left or right side 198, 199 of the deck, (ii) the top side 113 of the skateboard deck 111, and/or (iii) the bottom side 115 of the skateboard deck 111 (e.g., for protection or rail guard purposes for deck 111).

Guard/noseguard member 322 includes a recess 335 (e.g., molded recess 335). In exemplary embodiments, recess 335 is configured and dimensioned to provide a space/recess (335) to allow at least a portion of the front end 117 (or rear end 119, or side 198, or side 199) to be positioned within recess 335, with a top wall portion 337 of the member 322 being positioned above the top side 113 of deck 111, and with a bottom wall portion 339 being positioned below the bottom side 115 of deck 111.

Each end of the top wall portion 337 defines a wing portion 341. Each wing portion 341 includes a hole or aperture 345 therethrough for securement purposes of assembly 312 to assembly 100.

In exemplary embodiments, to secure assembly 312 to assembly 100, a portion of the front end 117 (or rear end 119, or side 198, or side 199) is positioned within recess 335, with top wall portion 337 (and top holes 345) positioned above the top side 113, and with bottom wall portion 339 positioned below the bottom side 115. A nut member 133 is then positioned relative to each top hole 345, and a fastener member 131 is positioned (from bottom side 115) through apertures 130 of deck 111. Each respective fastener member 131 and nut member 133 is then secured (e.g., threadably secured), tightened or mounted with respect to one another, which thereby causes the top wall portion 337 to be secured against or proximal to the top side 113 of the deck 111, and causes the bottom wall portion 339 to be secured against or proximal to the bottom side 115 of the deck 111.

Figure 27:
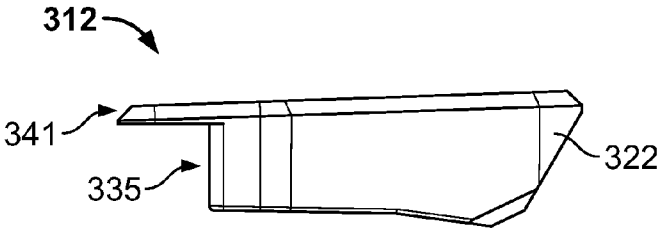
FIG. 27 is a side view of the noseguard assembly of FIG. 23.
Figure 29:
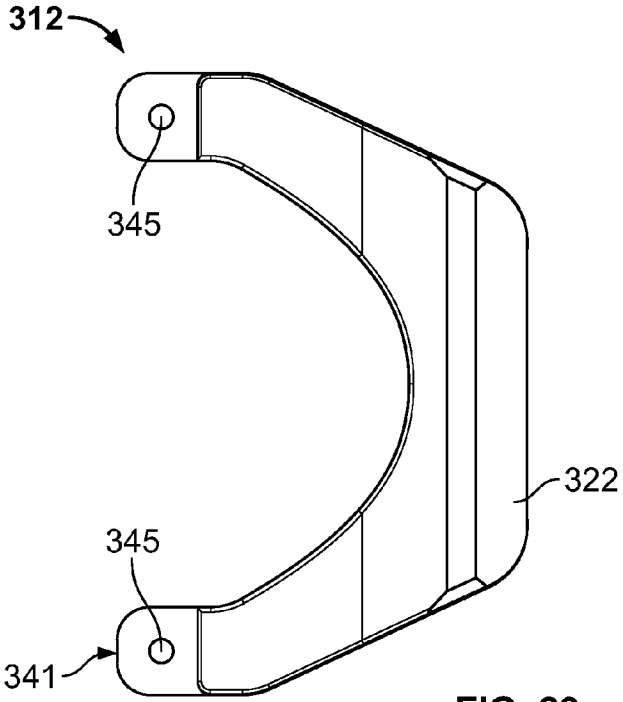
FIG. 29 is a bottom view of the noseguard assembly of FIG. 23.
Figure 26:
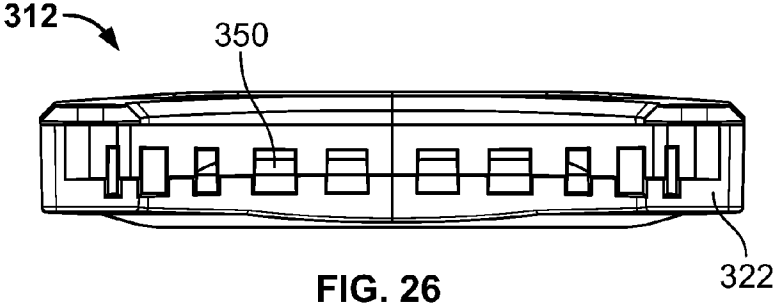
FIG. 26 is a rear view of the noseguard assembly of FIG. 23.
Figure 28:
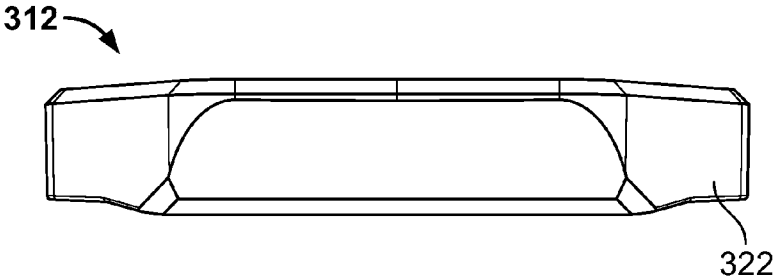
FIG. 28 is a front view of the noseguard assembly of FIG. 23.

In exemplary embodiments, the recess 335 of member 322 includes a plurality of slot members 350. As material is removed from the member 322, the slot members 350 become visible externally to the user, and when this happens the assembly 312 has lost enough material to be weakened and therefore needs to be replaced. In certain embodiments and as shown in FIG. 27, guard/noseguard member 322 has a non-homogenous thickness.

As noted above and as shown in FIGS. 30-33, exemplary moldable/curable material 401 (e.g., hand-moldable and self-adhesive compositions, etc.) can be utilized in conjunction with exemplary guard/noseguard assembly 412 for mounting purposes (e.g., to ends 117 or 119 and/or sides 198 or 199 of deck 111). However, it is noted that material 401 can be utilized in conjunction with other exemplary guard/noseguard members of the present disclosure discussed herein—112, 212, 312, 512, etc.).

As such, exemplary moldable material 401 can be utilized with the exemplary guard/noseguard members (122, 422, etc.) of the present disclosure in lieu of or in addition to utilizing fasteners 131/holes 130 and/or all of the other mounting methods/structures (e.g., fastener support members 132, nut members 133, etc.) of assemblies 112, 212, 312, 412, etc. disclosed herein.

As noted, moldable material 401 can take a variety of forms (e.g., single or multi-part plastic, epoxy, clay, rubber, putty, or other curable material, which is soft, or liquid, and then hardens, which is molded by hand, or otherwise, where the desired shape of the member is created and determined by the end user, by hand molding the material, or where the user uses a previously created cavity mold or other molding tool to press the curable material into the desired shape).

Figure 30:
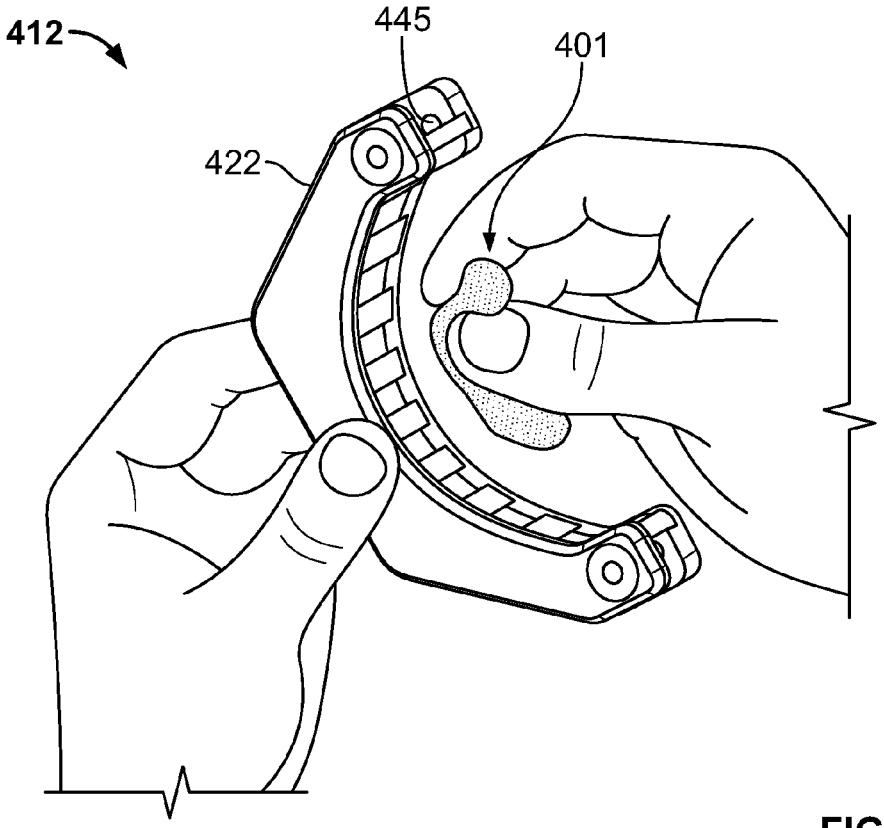
FIG. 30 is a top perspective view of an exemplary noseguard assembly, prior to mounting to a skateboard assembly.
Figure 31:
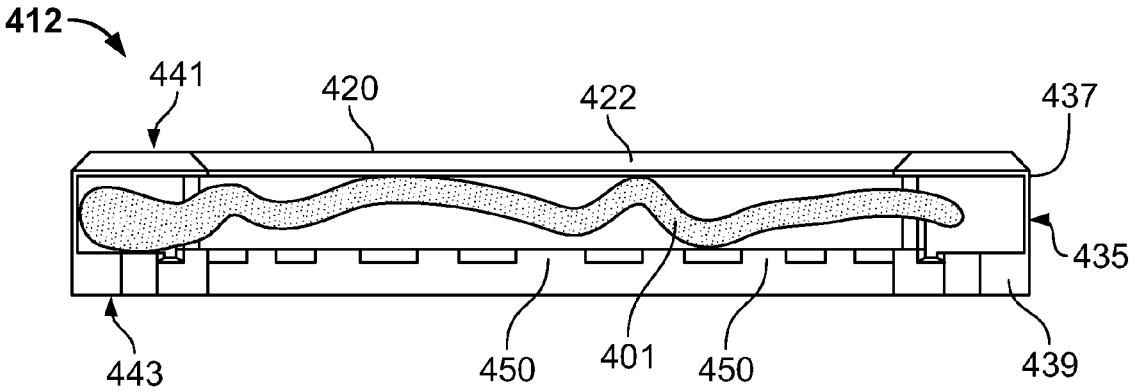
FIG. 31 is a rear view of the noseguard assembly of FIG. 30, prior to mounting to a skateboard assembly.
Figure 32:
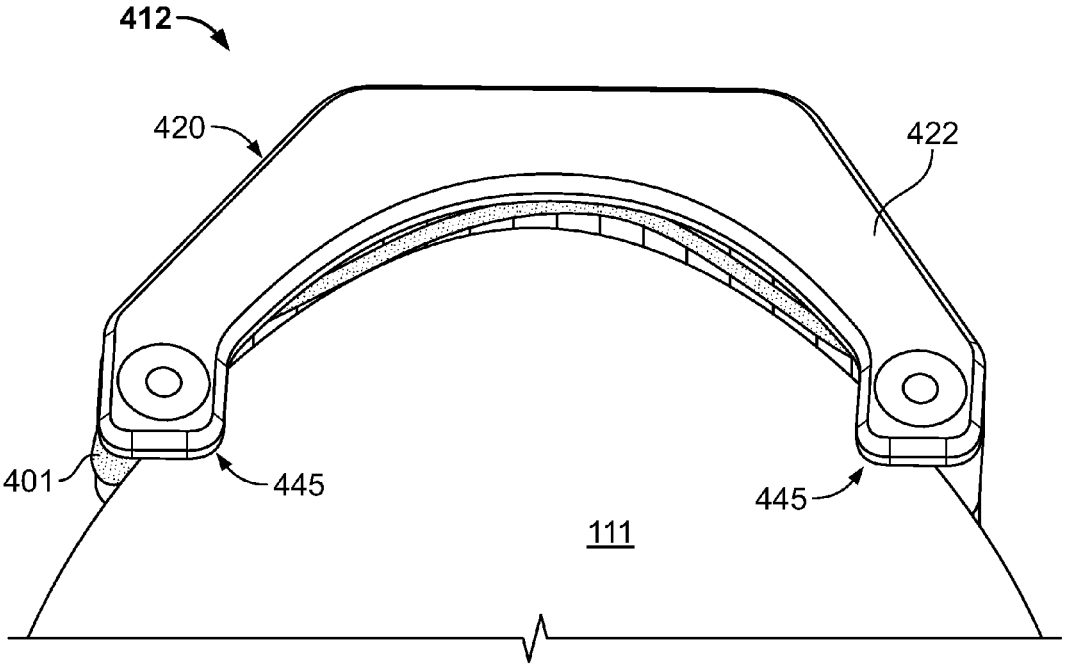
FIG. 32 is a top perspective view of the noseguard assembly of FIG. 30, prior to mounting to a skateboard assembly.

As shown in FIGS. 30-31, a user can mold material 401 to a desired shape, and then place/position the material 401 on and/or to a desired location on guard/noseguard member 422 of assembly 412 (FIG. 31). As shown in FIG. 31, the material 401 can be substantially positioned within recess 435 of guard/noseguard member 422, although the present disclosure is not limited thereto.

Figure 33:
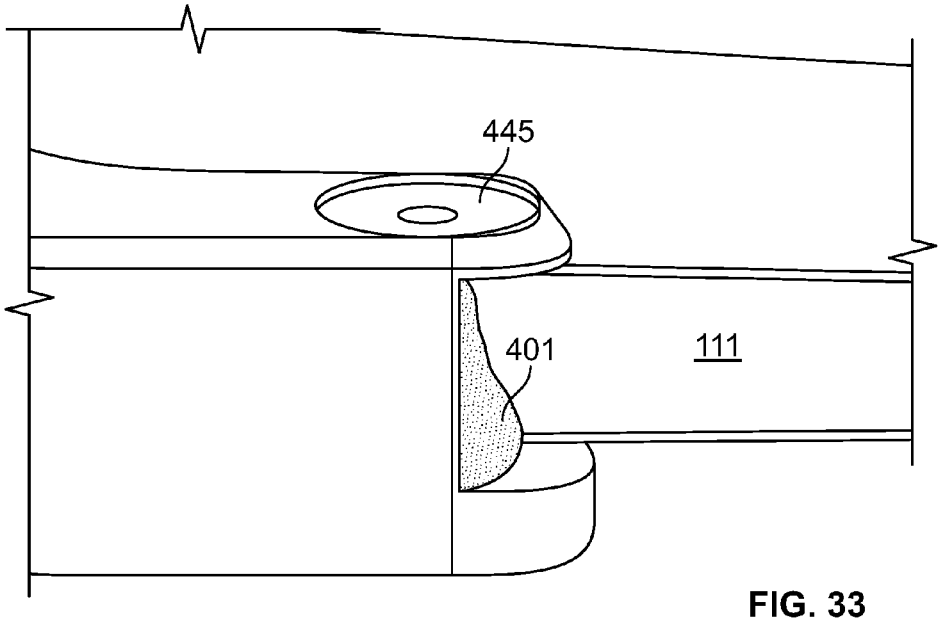
FIG. 33 is a partial side perspective view of the noseguard assembly of FIG. 30, after mounting the noseguard assembly to a skateboard assembly.
Figure 34:
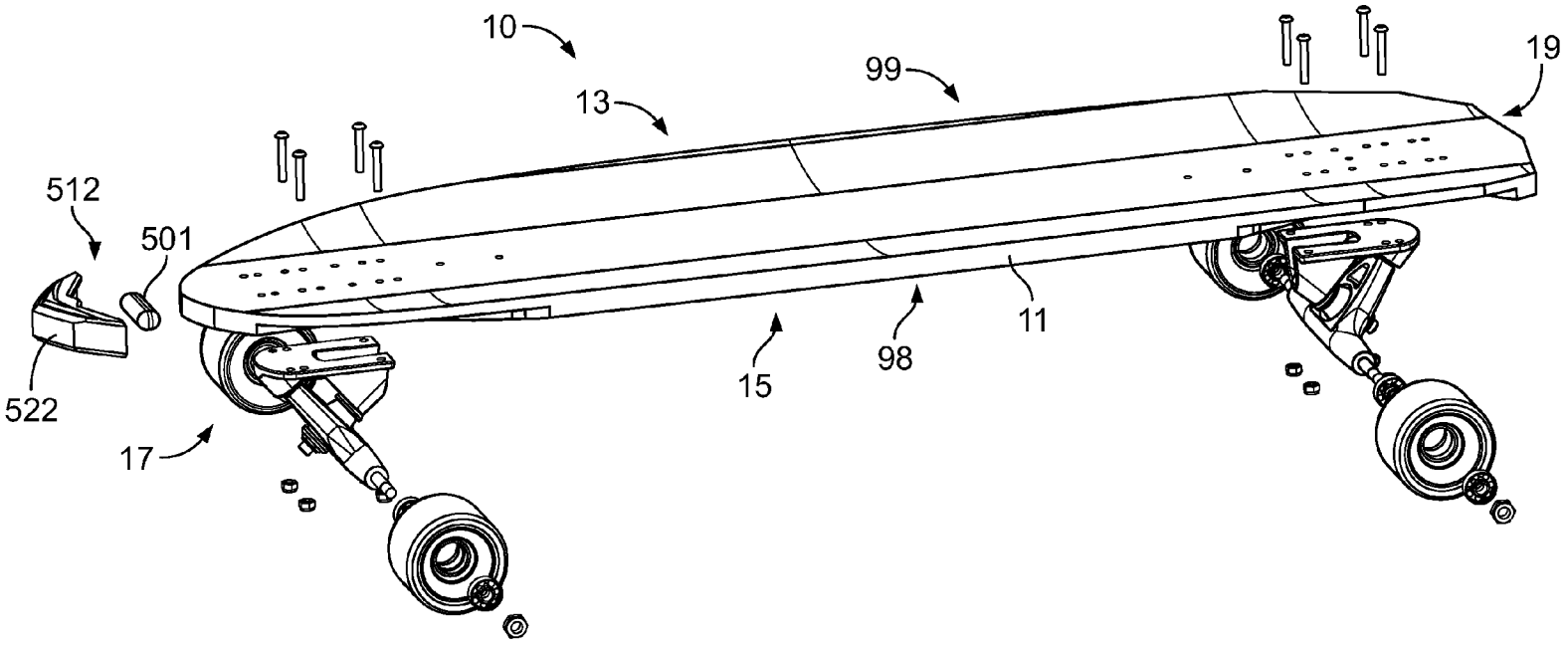
FIG. 34 is a side perspective view of an exemplary skateboard assembly according to the present disclosure, prior to exemplary guard/noseguard assembly being mounted thereon.
Figure 35:
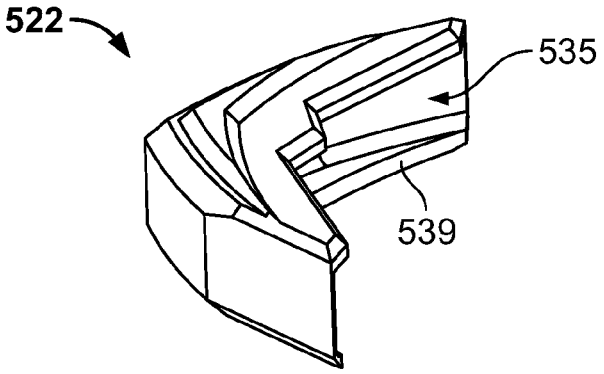
FIG. 35 is a top side perspective view of the guard assembly of FIG. 34.
Figure 36:
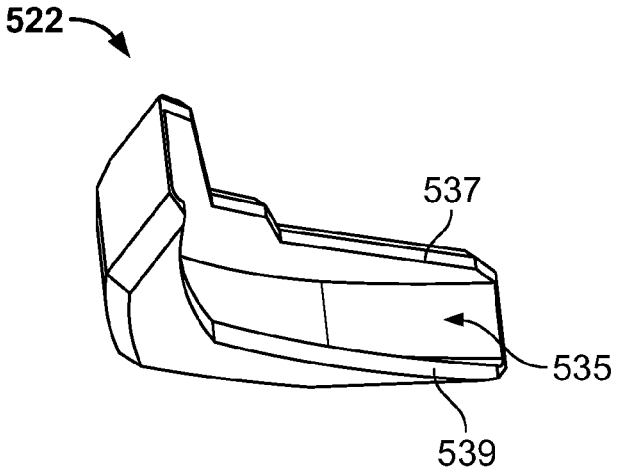
FIG. 36 is a bottom side perspective view of the guard assembly of FIG. 34.
Figure 37:
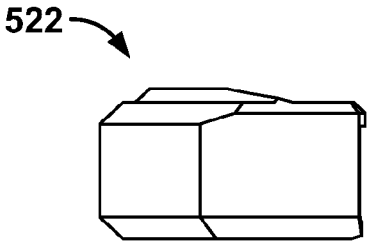
FIG. 37 is a side view of the guard assembly of FIG. 34.
Figure 38:
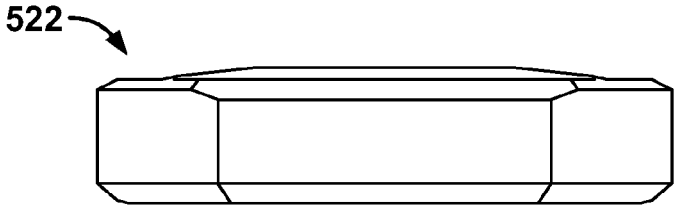
FIG. 38 is a front view of the guard assembly of FIG. 34.
Figure 39:
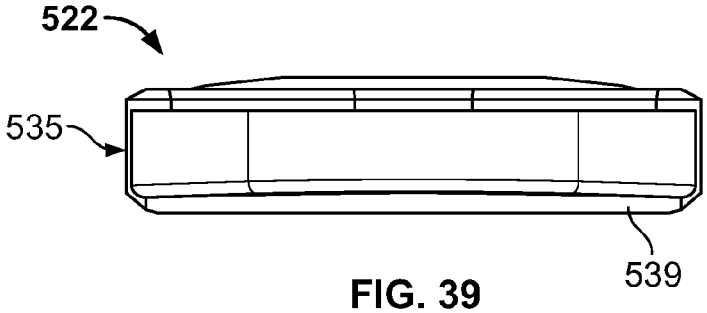
FIG. 39 is a rear view of the guard assembly of FIG. 34.
Figure 40:
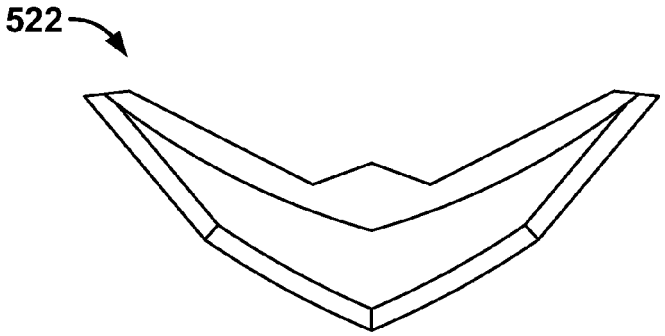
FIG. 40 is a bottom view of the guard assembly of FIG. 34.
Figure 41:
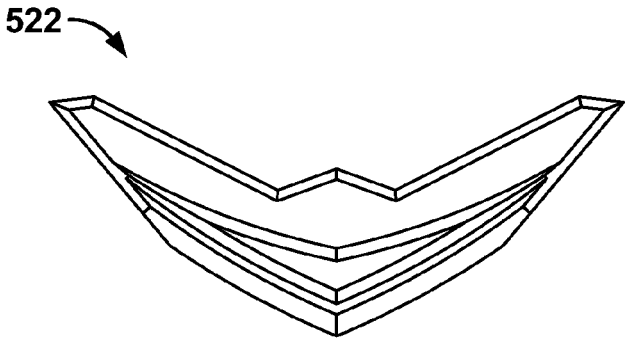
FIG. 41 is a top view of the guard assembly of FIG. 34.

As shown in FIG. 33, the user may then press the member 422 onto deck 111 for mounting purposes and allow the material to cure/harden, which thereby securely mounts material 401 and member 422 to deck 111 (e.g., to ends 117 or 119 and/or sides 198 or 199 of deck 111). It is noted that material 401 can be positioned at various locations of member 422 (e.g., positioned within the entire or partial length of recess 435 of member 422). As shown in FIG. 33, after adhering/securing member 422, the material 401 can act as a buffer and take up space between the adhered surfaces of the deck 111 (e.g., ends 117 or 119, and/or sides 113, 115, 198, 199) and member 422. Moreover, it is also noted that material 401 can take-up/fill spaces of member 422 that would otherwise remain unfilled/empty, thereby providing a more secure mount to deck 111 (e.g., eliminating a poor mounting fit between member 422 and deck 111). It is noted that deck 111 may or may not include grip-tape or the like (e.g., on its top surface 113).

As such, the present disclosure provides for a guard/noseguard member 422 that is configured and dimensioned for (impact) protection or rail guard purposes for deck 111, and that is configured to be mounted/adhered to a board/deck 111 with a single or multi-part plastic, epoxy, clay, rubber, putty, or other curable material 401, which is soft and then hardens, which is molded by hand by the user, or otherwise molded, in such a way as to adhere the member 422 to one or more surfaces of the board/deck 111 (or to the grip tape abrasive adhesive paper covering a surface of that board), using the mechanical bond created by the air dry, curing or solidifying of the moldable curable material 401, and where that moldable curable material 401, upon curing, drying or cooling, retains some flexibility or additional volume to enhance the durability, or expand the range of surface shapes a member 422 can effectively be adhered or mounted thereto.

Furthermore, the present disclosure provides for a guard/noseguard member 422 configured for use with a moldable curable material 401, and also having (drilled) mounting holes (either smooth or threaded), or other additional mechanical methods of fixing the member 422 to the board contact surface using additional screws, bolts, nuts or other hardware, which may be used simultaneously, or instead of, the moldable curable material 401.

Moreover, the present disclosure provides for a guard/noseguard member 422 configured and dimensioned for use with a moldable/curable material 401, with the member 422 having contact surfaces designed for improved adhesion with the material 401. For example, member 422 can have modified/textured surfaces by adding or removing material from member 422 in order to improve the adhesion with that moldable curable material 401, and/or member 422 having modified/textured surfaces that use embossed or de-bossed grids, hashed, dimpled, or serrated surfaces, drilled holes, geometric shapes or patterns, or other structures/methods designed to improve mechanical bonding and modify leverage to result in a stronger and longer lasting bond between the member 422, the curable material 401, and/or the board (or grip tape/abrasive adhesive paper) contact surface.

For example, when developing protective devices/members such as members 422, etc. for use with skateboards (or other boards), a design problem that might have to be overcome is the fit of the member (e.g., 422) relative to the profile of the board edge that is being protected. A device/member (422) that does not substantially match the profile of the board closely enough will be less durable, or may not be able to be adhered at all.

Furthermore with respect to the construction of these devices/members (422), a harder/stiffer material is generally more desirable as it is more resistant to abrasion, while a softer more flexible material is also generally more desirable since it is less likely to shatter in an extreme impact or the like.

In order to solve these two exemplary problems the protective device/member (422), the guard member (e.g., 422, etc.) can use a moldable curable material (e.g., 401) as an adhesive. For example, a moldable curable material (401) such as a single part, or multi-part, plastic, epoxy, clay, rubber, putty, or other curable material, which is soft, or liquid, and then hardens can be molded by hand (or otherwise molded) between the desired inner contact surface (e.g., recess 435) of the protective device/member (422) and the desired contact profile of the board.

When pressure is applied, and the moldable curable material 401 is allowed to set, cure, cool or solidify, the protective device/member (422) will be mechanically bonded to the board contact profile.

The advantage to this versus traditional adhesives is at least two-fold. Moldable curable materials (401) can be used which themselves have both volume and flexibility. The additional volume that the moldable curable material 401 adds to the assembly (412) allows the contact surface of the protective device/member (422) to differ greatly from the contact profile of the board while still maintaining strength, since the moldable curable material 401 takes up this space. Additionally, since the moldable curable material 401 can be flexible and will absorb impact, the protective guard member (422) can be made of material that is both harder and more brittle without fear of shattering during extreme impacts.

The resulting system/assembly (412) of a very hard protective device/member (422) adhered to a board with a more flexible curable moldable material 401 can be more universally mountable to many different board contact profiles and will also be more durable versus impact, because of the impact resistance and shock absorption of the flexible moldable curable material 401.

Further, this system/assembly (412) can be improved by improving the adhesion between the protective device/member (422) and the skateboard by modifying the inner contact surface(s) of the protective device/member (422) to increase the surface area via adding texture, contours, curves, holes, slots, or other features to 422, which will serve to strengthen the mechanical bond between the moldable curable material 401 and the member 422.

Additionally and in certain embodiments, adhesion can also be increased using spray adhesives that change the chemical composition of the surface of the protective device/member (422) and so increase the bond with the moldable curable material 401. Alternately, the protective device/member (422) can also use traditional drill holes (130), nuts, bolts or other methods of mechanical adhesion to increase the strength of the overall assembly 412, as noted and discussed above.

Additionally and in certain embodiments, the present disclosure provides for deck 111 with a standing surface, or other contact surface, for use with guard/noseguard members (e.g., 422) adhered with, and/or created using, a moldable material 401, with the deck 111 having contact surfaces/structures designed for improved adhesion with the material 401. For example, these modified surfaces of deck 111 may use embossed or de-bossed grids, hashed, dimpled, or serrated surfaces, drilled holes, geometric shapes or patterns, or other methods/structures designed to improve mechanical bonding and modify leverage to result in a stronger and longer lasting bond between the guard/noseguard member (422), the curable material 401, and/or the skateboard contact surface (e.g., ends 117, 199, sides 113 and/or 115, and/or 198, 199).

It is also noted that there are many shapes and styles of skateboards (or other boards like surfboards, snowboards, wakeboards, etc.), and many of these styles have ends/sides, top standing surfaces, profile surfaces, and/or bottom surfaces that are wholly and completely different from one another. Many of those different surfaces can generally require a guard/noseguard member to have a contact surface specifically molded to fit the given board surface/end in instances where the member is not flexible enough to bend to fit the surface shape.

In these instances, certain exemplary guard/noseguard members of the present disclosure can be mounted/adhered to the board by the user/rider prior to use, utilizing a moldable (e.g., by hand or otherwise) material 401 or the like, which itself has both shape and volume and can be molded to more universally fit between the contact surfaces of the guard/noseguard member and the many varying board surfaces that are used in differing skateboard styles and designs.

It is further noted that one or both of the mounting surface of the skateboard deck, and/or the contact/mounting surfaces of the guard/noseguard member can be scoured, etched, scratched, extruded or molded to include recesses, hash marks, grids, holes or dimples that can serve to increase the adhesion between the material 401, the desired surface of the skateboard and the mounting surface(s) of the guard/noseguard member (e.g., 422).

In another embodiment, a surface of the skateboard deck 111 could be covered with grip tape, an adhesive backed abrasive paper, or adhesive backed sandpaper, prior to application of the moldable putty substance 401. In this embodiment, the moldable material 401 can serve the same function, but would instead bind the surface of the adhesive backed abrasive paper and the mounting surface(s) of the guard/noseguard member (422).

In other embodiments, the guard/noseguard member 422 can make use of adhesion by both the moldable/curable material 401, and with nuts, bolts, screws 131 or other mechanical methods simultaneously. However and as noted above, exemplary moldable material 401 can be utilized with the exemplary guard/noseguard members (122, 422, etc.) of the present disclosure in lieu of or in addition to utilizing fasteners 131/holes 130 and/or all of the other mounting methods/structures (e.g., fastener support members 132, nut members 133, etc.) of assemblies 112, 212, 312, 412, etc. disclosed herein.

In certain embodiments and referring back to FIGS. 30-33, guard/noseguard assembly 412 can be mounted with respect to: (i) the front 117 or rear end 119 of the deck 111, (ii) the top side 113 of the skateboard deck 111, and/or (iii) the bottom side 115 of the skateboard deck 111 (e.g., by utilizing material 401 and/or by utilizing two fasteners 131 and two corresponding fastener support members 132).

In other embodiments, it is noted that guard assembly 412 can be configured and dimensioned to be mounted with respect to: (i) left or right side 198, 199 of the deck, (ii) the top side 113 of the skateboard deck 111, and/or (iii) the bottom side 115 of the skateboard deck 111 (e.g., for protection or rail guard purposes for deck 111).

Noseguard member 422 includes a recess 435 (e.g., molded recess 435—FIG. 31). In exemplary embodiments, recess 435 is configured and dimensioned to provide a space/recess (435) to allow at least a portion of the rear end 119 (or front end 117, or side 198, or side 199) to be positioned within recess 435, with a top wall portion 437 of the guard/noseguard member 422 being positioned above the top side 113 of deck 111, and with a bottom wall portion 439 being positioned below the bottom side 115 of deck 111.

Each end of the top wall portion 437 defines a wing portion 441, and each end of the bottom wall portion 439 defines a wing portion 443. Each wing portion 441, 443 includes a hole or aperture 445 therethrough for (optional) securement purposes of assembly 412 to assembly 100.

In some embodiments (e.g., with or without material 401), to secure assembly 412 to assembly 100, a portion of the end 117 or 119 (and/or side 198 and/or 199) is positioned within recess 435, with top wall portion 437 (and top holes 445) positioned above the top side 113, and with bottom wall portion 439 (and bottom holes 445) positioned below the bottom side 115. A fastener support member 132 can then be positioned within or relative to each bottom hole 445, and a fastener member 131 is positioned through each top hole 445 and through apertures 130 of deck 111. Each respective fastener member 131 and fastener support member 132 is then secured/tightened or mounted with respect to one another, as discussed above relative to assembly 112 (and via the alternative mounting methods discussed as well). However, it again noted that moldable material 401 can be utilized with assembly 412 in lieu of or in addition to utilizing fasteners 131/holes 130 and/or all of the other mounting methods/structures discussed above. Likewise, fasteners 131/holes 130 (or other mounting structures) can be utilized with assembly 412 in lieu of or in addition to utilizing moldable material 401.

In exemplary embodiments, the recess 435 of member 422 includes a plurality of slot members 450. As material is removed from the member 422, the slot members 450 become visible externally to the user, as similarly discussed above.

The top surface 420 of the assembly 412 can increase the top angle of the kicktail, relative to the original angle built into the board shape, which increases leverage and allows the rider to pop the board faster.

In other embodiments of the present disclosure, it is noted that the exemplary guard/noseguard members (e.g., similar to member 122, etc.) may be fabricated (e.g., extruded, printed, and/or 3D printed onto/against the board/deck 111) via an additive process, layer by layer, where plastic, metal, or other material is fused together and cools or cures as a result of the process. This thereby can create the desired guard/noseguard member while creating a mechanical bond on the desired contact surface of the board/deck which holds that new guard/noseguard member in place.

In some embodiments, the board/deck 111 surface is first coated with an adhesive of some kind to assist in mechanical bonding (however in other embodiments this is not necessary). Extruded guard/noseguard members may be removed from the surface of the board/deck and re-adhered via a different adhesive process to the same or a different board.

As such, the present disclosure provides for a skateboard assembly having one more additive-based guard/noseguard members added after pressing/production is completed. The additive-based guard/noseguard members can be added to an end/side of the board/deck in order to provide the guard/noseguard assembly benefits discussed above. Such exemplary additive based members can be printed, extruded, or otherwise built up layer by layer via a progressive additive process where material is added or joined to the board/deck surface/end, layer by layer, and where the material/process of the additive based members incorporates some form of curing or cooling that mechanically bonds the additional contours or members/surfaces directly to the board/deck surface (e.g., either with the help of an additional layer of spray adhesive or without).

In another embodiment and as shown in FIGS. 34-41, this guard/noseguard assembly 512 can be mounted with respect to: (i) the front end 17 (or rear end 19) of the deck 11, (ii) the top side 13 of the skateboard deck 11, and/or (iii) the bottom side 15 of the skateboard deck 11 (e.g., by utilizing moldable material 501, and with no fasteners 131 or the like).

In other embodiments, it is noted that guard assembly 512 can be configured and dimensioned to be mounted with respect to: (i) left or right side 98, 99 of the deck, (ii) the top side 13 of the skateboard deck 11, and/or (iii) the bottom side 15 of the skateboard deck 11 (e.g., for protection or rail guard purposes for deck 11).

Guard/noseguard member 522 includes a recess 535 (e.g., molded recess 535). In exemplary embodiments, recess 535 is configured and dimensioned to provide a space/recess (535) to allow at least a portion of the front end 17 (or rear end 19, or side 98, or side 99) to be positioned within recess 535, with a top wall portion 537 of the member 522 being positioned above the top side 13 of deck 11, and with a bottom wall portion 539 being positioned below the bottom side 15 of deck 11.

In exemplary embodiments, to secure assembly 512 to assembly 10, a portion of the front end 17 (or rear end 19, and/or side 98, and/or side 99) is positioned within recess 535, with top wall portion 537 positioned above the top side 13, and with bottom wall portion 539 positioned below the bottom side 15.

In some embodiments, the recess 535 of member 522 may or may not include a plurality of slot members, as similarly discussed above.

Exemplary moldable/curable material 501 (e.g., hand-moldable and self-adhesive compositions, etc.) can be utilized in conjunction with exemplary guard/noseguard assembly 512 for mounting purposes (e.g., to ends 17 or 19 and/or sides 98 or 99 of deck 11).

Like material 401, moldable material 501 can take a variety of forms (e.g., single or multi-part plastic, epoxy, clay, rubber, putty, or other curable material, which is soft, or liquid, and then hardens, which is molded by hand, or otherwise, where the desired shape of the member is created and determined by the end user, by hand molding the material, or where the user uses a previously created cavity mold or other molding tool to press the curable material into the desired shape).

A user can mold material 501 to a desired shape, and then place/position the material 501 on and/or to a desired location on guard/noseguard member 522 of assembly 512. For example, the material 501 can be substantially positioned within recess 535 of guard/noseguard member 522, although the present disclosure is not limited thereto.

The user may then press the member 522 onto deck 11 for mounting purposes and allow the material to cure/harden, which thereby securely mounts material 501 and member 522 to deck 11 (e.g., to ends 17 or 19 and/or sides 98 or 99 of deck 11). It is noted that material 501 can be positioned at various locations of member 522 (e.g., positioned within the entire or partial length of recess 535 of member 522). After adhering/securing member 522, the material 501 can act as a buffer and take up space between the adhered surfaces of the deck 11 (e.g., ends 17 or 19, and/or sides 13, 15, 98, 99) and member 522. Moreover, it is also noted that material 501 can take-up/fill spaces of member 522 that would otherwise remain unfilled/empty, thereby providing a more secure mount to deck 11 (e.g., eliminating a poor mounting fit between member 522 and deck 511). Deck 11 may or may not include grip-tape or the like (e.g., on its top surface 13).

Whereas the disclosure has been described principally in connection with advantageous skateboard assemblies or guard/noseguard assemblies (e.g., advantageous skateboard guard/noseguard assemblies) for recreational, domestic and/or commercial uses/purposes, such description has been utilized only for purposes of disclosure and is not intended as limiting the disclosure. To the contrary, it is to be recognized that the disclosed guard/noseguard assemblies are capable of use for other sports and/or uses/purposes (e.g., as mountable guard/noseguard assemblies for surfboards, snowboards, wakeboards, and/or other board sports or vehicles, etc.).

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A skateboard assembly comprising:

a skateboard deck having a top side, a bottom side, a front end and a rear end;

a guard assembly that includes a guard member having: (i) a contoured top surface, and (ii) a top wall and a bottom wall, with a recess positioned between the top and bottom walls;

wherein the recess is configured and dimensioned to provide a space to allow at least a portion of the skateboard deck to be positioned within the recess, with the top wall positioned above the top side of the skateboard deck and with the bottom wall positioned below the bottom side of the skateboard deck;

wherein the guard assembly is configured and dimensioned to be mounted with respect to: (i) the top side of the skateboard deck, and (ii) the bottom side of the skateboard deck;

wherein the contoured top surface of the guard member is configured and dimensioned to provide a user a surface that the user can utilize to place or position a foot directly onto or above, with a bottom side of the user's foot contacting the contoured top surface of the mounted guard member during use; and wherein the recess includes a plurality of slot members, the plurality of slot members configured and dimensioned to be visible externally to the user after a pre-determined amount of material is removed from the guard member.

2. The skateboard assembly of claim 1, wherein the end of the top or bottom wall of the guard member defines a wing portion, the wing portion including a hole therethrough for mounting purposes of the guard assembly to the skateboard deck.

3. The skateboard assembly of claim 1, wherein the guard assembly is configured and dimensioned to be mounted with respect to: (i) the front or rear end of the skateboard deck, (ii) the top side of the skateboard deck, and (iii) the bottom side of the skateboard deck by utilizing two fastener members and two corresponding fastener support members.

4. The skateboard assembly of claim 1, wherein the mounted guard assembly provides protection for the skateboard deck.

5. The skateboard assembly of claim 1, wherein the guard member includes, at least in part, a moldable and curable material.

6. A skateboard guard assembly comprising:

a guard member having: (i) a contoured top surface, and (ii) a top wall and a bottom wall, with a recess positioned between the top and bottom walls;

wherein the recess is configured and dimensioned to provide a space to allow at least a portion of a skateboard deck to be positioned within the recess, with the top wall positioned above a top side of the skateboard deck and with the bottom wall positioned below a bottom side of the skateboard deck;

wherein the guard member is configured and dimensioned to be mounted with respect to: (i) the top side of the skateboard deck, and (iii) the bottom side of the skateboard deck;

wherein the contoured top surface of the guard member is configured and dimensioned to provide a user a surface that the user can utilize to place or position a foot directly onto or above, with a bottom side of the user's foot contacting the contoured top surface of the mounted guard member during use; and wherein the recess includes a plurality of slot members, the plurality of slot members configured and dimensioned to be visible externally to the user after a pre-determined amount of material is removed from the guard member.

7. The skateboard guard assembly of claim 6, wherein the end of the top or bottom wall of the guard member defines a wing portion, the wing portion including a hole therethrough for mounting purposes of the guard member to the skateboard deck.

8. The skateboard guard assembly of claim 6, wherein the guard member is configured and dimensioned to be mounted with respect to: (i) a front or a rear end of the skateboard deck, (ii) the top side of the skateboard deck, and (iii) the bottom side of the skateboard deck by utilizing two fastener members and two corresponding fastener support members.

9. The skateboard guard assembly of claim 6, wherein the mounted guard member provides protection for the skateboard deck.

10. The skateboard guard assembly of claim 6, wherein the guard member includes, at least in part, a moldable and curable material.

11. A mounting method comprising:

providing a skateboard deck;

providing a guard member having: (i) a contoured top surface, and (ii) a top wall and a bottom wall, with a recess positioned between the top and bottom walls;

positioning at least a portion of the skateboard deck within the recess, with the top wall positioned above a top side of the skateboard deck and with the bottom wall positioned below a bottom side of the skateboard deck;

mounting the guard member with respect to: (i) the top side of the skateboard deck, and (iii) the bottom side of the skateboard deck;

wherein the contoured top surface of the guard member is configured and dimensioned to provide a user a surface that the user can utilize to place or position a foot directly onto or above, with a bottom side of the user's foot contacting the contoured top surface of the mounted guard member during use; and wherein the recess includes a plurality of slot members, the plurality of slot members configured and dimensioned to be visible externally to the user after a pre-determined amount of material is removed from the guard member.

12. The method of claim 11, wherein the end of the top or bottom wall of the guard member defines a wing portion, the wing portion including a hole therethrough for mounting purposes of the guard member to the skateboard deck.

13. The method of claim 11, wherein the guard member is mounted with respect to: (i) the front or rear end of the skateboard deck, (ii) the top side of the skateboard deck, and (iii) the bottom side of the skateboard deck by utilizing two fastener members and two corresponding fastener support members.

14. The method of claim 11, wherein the guard member includes, at least in part, a moldable and curable material; and wherein the step of mounting the guard member with respect to the top side of the skateboard deck and to the bottom side of the skateboard deck includes mounting at least a portion of the moldable and curable material to the skateboard deck.

15. The method of claim 14, wherein at least a portion of the moldable and curable material is positioned within the recess prior to mounting the guard member with respect to the skateboard deck.

16. The method of claim 11, wherein the guard member is mounted with respect to the top side of the skateboard deck and to the bottom side of the skateboard deck via an additive process.

17. The method of claim 11, wherein after the guard member is mounted with respect to the skateboard deck, the guard member provides protection for the skateboard deck.

* * * * *